US007850580B2

(12) United States Patent
Johnson et al.

(10) Patent No.: US 7,850,580 B2
(45) Date of Patent: Dec. 14, 2010

(54) RESISTANCE EXERCISE APPARATUS

(75) Inventors: Noel R. Johnson, Stoughton, WI (US); Tou T. Vang, DeForest, WI (US)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 144 days.

(21) Appl. No.: 11/952,583

(22) Filed: Dec. 7, 2007

(65) Prior Publication Data

US 2009/0149301 A1 Jun. 11, 2009

(51) Int. Cl.
*A63B 21/06* (2006.01)
*A63B 21/00* (2006.01)
*A63B 21/02* (2006.01)

(52) U.S. Cl. ..... 482/92; 482/93; 482/121

(58) Field of Classification Search ..... 482/92–93, 482/98, 121
See application file for complete search history.

(56) References Cited

U.S. PATENT DOCUMENTS 4,709,920 A * 12/1987 Schnell ..... 482/100
4,763,897 A * 8/1988 Yakata ..... 482/100
5,039,092 A 8/1991 Olschansky et al.
5,067,708 A 11/1991 Oschansky et al.
5,074,551 A 12/1991 Olschansky et al.
5,102,121 A * 4/1992 Solow et al. ..... 482/94
5,178,597 A * 1/1993 Jones ..... 482/100
5,476,428 A * 12/1995 Potash et al. ..... 482/5
5,722,921 A * 3/1998 Simonson ..... 482/100
5,776,040 A * 7/1998 Webb et al. ..... 482/98
5,876,313 A 3/1999 Krull
5,935,048 A * 8/1999 Krull ..... 482/98
5,944,642 A * 8/1999 Krull ..... 482/98
6,015,367 A * 1/2000 Scaramucci ..... 482/5
6,033,350 A * 3/2000 Krull ..... 482/98
6,117,049 A * 9/2000 Lowe ..... 482/4
6,183,401 B1 * 2/2001 Krull ..... 482/98
6,186,927 B1 2/2001 Krull
6,193,635 B1 * 2/2001 Webber et al. ..... 482/98
6,224,519 B1 * 5/2001 Doolittle ..... 482/98
6,277,058 B1 * 8/2001 Sparks ..... 482/98
6,387,019 B1 * 5/2002 Krull ..... 482/98
6,416,446 B1 * 7/2002 Krull ..... 482/108
6,422,979 B1 * 7/2002 Krull ..... 482/98
6,436,013 B1 * 8/2002 Krull ..... 482/94
6,447,432 B1 * 9/2002 Krull ..... 482/98
6,527,683 B2 * 3/2003 Tolles ..... 482/99
6,540,650 B1 * 4/2003 Krull ..... 482/107
6,565,495 B2 * 5/2003 Slattery ..... 482/142
6,592,498 B1 * 7/2003 Trainor ..... 482/97
6,629,910 B1 * 10/2003 Krull ..... 482/98
6,632,161 B1 * 10/2003 Nir ..... 482/98

(Continued)

*Primary Examiner*—Steve R Crow
*Assistant Examiner*—Robert F Long
(74) *Attorney, Agent, or Firm*—Michael Best & Friedrich LLP

(57) ABSTRACT

A resistance exercise apparatus comprises a frame, a guide mounted on the frame, a resistance support movable relative to the guide along a path; and a resistance assembly for applying a resistance during an exercise. The resistance assembly includes a first resister having a first resistance, and a second resister having a second resistance. The first resistance and the second resistance are selectively and independently applied by the first resister and the second resister during an exercise. The first resister and the second resister are each arranged substantially symmetrically relative to the path.

19 Claims, 30 Drawing Sheets

U.S. PATENT DOCUMENTS 6,666,800 B2 * 12/2003 Krull ..... 482/94
6,669,606 B2 * 12/2003 Krull ..... 482/98
6,719,674 B2 * 4/2004 Krull ..... 482/106
6,733,424 B2 * 5/2004 Krull ..... 482/98
6,746,381 B2 * 6/2004 Krull ..... 482/108
6,749,547 B2 * 6/2004 Krull ..... 482/106
6,855,097 B2 * 2/2005 Krull ..... 482/107
6,872,173 B2 * 3/2005 Krull ..... 482/108
6,889,661 B2 5/2005 Duplat et al.
6,896,645 B1 * 5/2005 Krull ..... 482/107
6,899,661 B1 * 5/2005 Krull ..... 482/107
6,902,516 B2 * 6/2005 Krull ..... 482/98
6,974,405 B2 12/2005 Krull
6,994,660 B2 * 2/2006 Ish et al. ..... 482/98
7,011,609 B1 * 3/2006 Kuo ..... 482/94
7,060,010 B2 * 6/2006 Daniel ..... 482/94
7,060,011 B1 * 6/2006 Krull ..... 482/107
7,077,791 B2 7/2006 Krull
7,153,243 B1 * 12/2006 Krull ..... 482/107
7,172,535 B2 * 2/2007 Volmar ..... 482/101
7,195,584 B1 3/2007 Lu et al.
7,252,627 B2 * 8/2007 Carter ..... 482/98
7,261,678 B2 8/2007 Crawford et al.
7,367,927 B2 * 5/2008 Krull ..... 482/107
7,413,532 B1 * 8/2008 Monsrud et al. ..... 482/99
2001/0003723 A1 * 6/2001 Krull ..... 482/98
2002/0025888 A1 * 2/2002 Germanton et al. ..... 482/1
2002/0049123 A1 * 4/2002 Krull ..... 482/98
2002/0055426 A1 * 5/2002 Krull ..... 482/98
2003/0092542 A1 * 5/2003 Bartholomew et al. ..... 482/99
2005/0085351 A1 4/2005 Kissel
2005/0176559 A1 * 8/2005 Carter ..... 482/94
2005/0176560 A1 * 8/2005 Chen ..... 482/94
2006/0105888 A1 * 5/2006 Piane, Jr. ..... 482/94
2006/0205889 A1 9/2006 Laakso, Jr. et al.
2006/0211550 A1 9/2006 Crawford et al.
2006/0217245 A1 * 9/2006 Golesh et al. ..... 482/94
2006/0223684 A1 10/2006 Krull
2007/0161468 A1 * 7/2007 Yanagisawa et al. ..... 482/94
2007/0270293 A1 * 11/2007 Zhuang ..... 482/123
2008/0039302 A1 * 2/2008 Grant ..... 482/121
2008/0176713 A1 * 7/2008 Olivera Brizzio et al. ..... 482/8
2008/0318740 A1 * 12/2008 Ross et al. ..... 482/92

* cited by examiner

| SELECTOR CONFIGURATION | | | | | | | | | | |
|---|---|---|---|---|---|---|---|---|---|---|
| | 60 | 15 | 30 | 15 | 30 | 15 | 60 | TARE+WEIGHT | ADD 5 | ADD 10 |
| 1 | | | | | | | | 15 | 20 | 25 |
| 2 | | | | x | | | | 30 | 35 | 40 |
| 3 | | x | | | | x | | 45 | 50 | 55 |
| 4 | | x | | x | | x | | 60 | 65 | 70 |
| 5 | | | x | | x | | | 75 | 80 | 85 |
| 6 | | | x | x | x | | | 90 | 95 | 100 |
| 7 | | x | x | | x | x | | 105 | 110 | 115 |
| 8 | | x | x | x | x | x | | 120 | 125 | 130 |
| 9 | x | | | | | | x | 135 | 140 | 145 |
| 10 | x | | | x | | | x | 150 | 155 | 160 |
| 11 | x | x | | | | x | x | 165 | 170 | 175 |
| 12 | x | x | | x | | x | x | 180 | 185 | 190 |
| 13 | x | | x | | x | | x | 195 | 200 | 205 |
| 14 | x | | x | x | x | | x | 210 | 215 | 220 |
| 15 | x | x | x | | x | x | x | 225 | 230 | 235 |
| 16 | x | x | x | x | x | x | x | 240 | 245 | 250 |

RESISTANCE EXERCISE APPARATUS

FIELD OF THE INVENTION

The present invention relates to a resistance exercise apparatus and, more particularly, to a resistance exercise apparatus which has an improved resistance arrangement.

SUMMARY OF THE INVENTION

Indoor exercise is getting more and more popular during recent decades. One popular indoor exercise apparatus is the resistance exercise machine.

The resistance exercise machine typically includes a movable element to which the user applies a force to provide the exercise. The movable element is commonly connected through a mechanical linkage to a resistance assembly that provides the resistance.

In some machines, the resistance assembly includes a vertical central lifting bayonet, and a stack of vertically-arranged weight plates that are vertically movable with the central lifting bayonet during an exercise. The central lifting bayonet has a plurality of selection holes arranged vertically, and each weight plate has a through plate hole aligned with a corresponding one of the selection holes. A number of weight plates can be selected by inserting a selection pin through the plate hole of one weight plate into a corresponding selection hole of the central lifting bayonet, to thereby select the amount of resistance applied during exercise.

One drawback of this resistance exercise machine is that the selection pin can be difficult to insert into the stack and bayonet due to the large tolerance stack-up inherent to a weight stack. That is, the plate holes of the weight plates and the selection holes of the bayonet do not always line up due to small variations inherent in the manufacturing process.

In addition, the typical vertical weight stack cannot be totally enclosed due to the need to allow a user to insert the selection pin into the weight stack and bayonet. The exposed weight stack can be cosmetically undesirable.

Moreover, the user may often need to bend down to make the weight selection. This may make the user uncomfortable because of the bending down posture.

The present application discloses a resistance exercise apparatus that facilitates balanced resistance forces, and facilitates independent displacement of separate resistance forces. The apparatus comprises a frame, a guide (e.g., two guide rods) mounted on the frame, a resistance support movable relative to the guide (e.g., slidable along the guide rods) and including an input location, a transmission assembly coupled to the input location, and a resistance assembly for applying a resistance to the resistance support during an exercise. The resistance assembly includes a first resister (e.g., one or more weights or elastic members) having a first resistance and a second resister (e.g., one or more weights or elastic members) having a second resistance. The first resistance and the second resistance are capable of being independently applied by the first resister and the second resister. The first resister and the second resister each is arranged substantially symmetrical relative to the input location. Additional resisters can be incorporated into the above-described arrangement.

The present application also discloses a resistance exercise apparatus that facilitates adjustment of resistive forces utilizing a remote adjustment assembly. This apparatus includes a frame, a resistance support movable relative to the frame, a resistance assembly at least partially movable with the resistance support during exercise, and an adjustment assembly.

The adjustment assembly includes a selector supported on the frame, and an adjustment mechanism interconnected with the selector. The adjustment mechanism is engageable with the resistance assembly to adjust the resistance to be applied by the resistance assembly. At least a portion of the resistance assembly is disengageable from and movable relative to the selector during the exercise.

In one embodiment, the adjustment mechanism includes a resistance gear assembly supported by the resistance assembly for movement with the resistance assembly during exercise, and an adjustment gear assembly supported by the frame and interconnected with the selector. The adjustment gear assembly is engageable with the resistance gear assembly to facilitate adjustment of the resistance to be applied by the resistance assembly. The resistance gear assembly is disengageable from the adjustment gear assembly during exercise.

Preferably, the apparatus further comprises an interlock assembly including a resistance gear lock assembly operable to retain the resistance gear assembly in a resistance setting orientation when the resistance gear assembly and the adjustment gear assembly are disengaged. The resistance gear lock assembly can include a pin engageable in a locking position between gear teeth of the resistance gear assembly to substantially prevent rotation of the resistance gear assembly from a resistance setting orientation when the resistance gear assembly and the adjustment gear assembly are disengaged. The pin is disengageable to an unlocking position when the resistance gear assembly and the adjustment gear assembly are engaged.

The interlock assembly can further include an adjustment gear lock assembly operable to retain the adjustment gear assembly in a resistance setting orientation when the resistance gear assembly and the adjustment gear assembly are disengaged. The adjustment gear lock assembly can include an adjustment gear pin engageable in a locking position between gear teeth of the adjustment gear assembly to substantially prevent rotation of the adjustment gear assembly from a resistance setting orientation when the resistance gear assembly and the adjustment gear assembly are disengaged. The pin is disengageable to an unlocking position when the resistance gear assembly and the adjustment gear assembly are engaged. Preferably, a biasing member operates to bias the adjustment gear pin toward the locking position.

The present application also discloses a method of operating a resistance exercise apparatus having a frame, a guide supported by the frame, a resistance support movable relative to the guide and including an input location, and a resistance assembly including a first resister having a first resistance and a second resister having a second resistance. The method comprises engaging the first resister with the resistance support while disengaging the second resister from the resistance support, exercising by applying a force at the input location and substantially symmetrical with the first resistance. The method continues by disengaging the first resister from the resistance support, engaging the second resister with the resistance support, and exercising by applying a force at the input location and substantially symmetrical with the second resistance. Finally, the method includes engaging the first resister and the second resister with the resistance support, and exercising by applying a force at the input location and substantially symmetrical with the first resistance and the second resistance.

Independent features and independent aspects of the invention will become apparent to those skilled in the art upon review of the following detailed description, claims, and drawings, wherein like elements have like numerals throughout the drawings.

Figure 1:
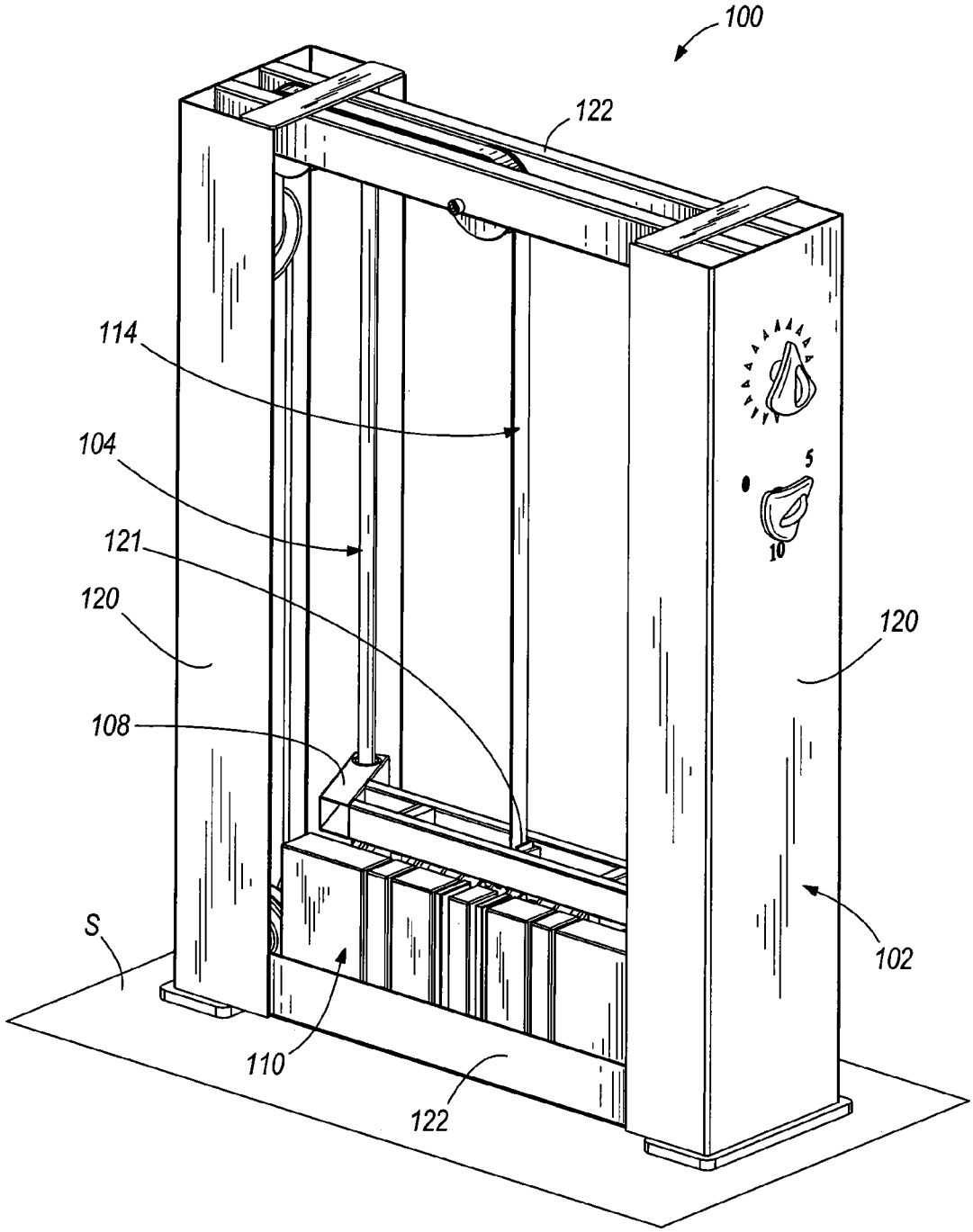
FIG. 1 is a perspective view of a resistance exercise apparatus embodying independent aspects of the present invention.

Before at least one independent embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

The use of "including", "having", and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

The resistance exercise apparatus 100 of FIG. 1 generally includes an apparatus frame 102, a guide 104, a carriage assembly or resistance support 108, a resistance assembly 110 to be carried or supported by the resistance support 108, and a transmission assembly 114. The apparatus frame 102 is supported on a surface S such as, for example, a floor surface in an exercise area. The apparatus frame 102 includes two side frame portions 120 connected by top and bottom end portions 122.

The resistance exercise apparatus 100 further includes an exercise portion (not shown) for enabling a user to apply a force to the transmission assembly 114 to perform the exercise. The exercise portion and a connecting assembly (not shown) could be constructed to be similar to the embodiment described below (e.g., the exercise assembly 370 and/or 374 shown in FIG. 19).

Figure 2:
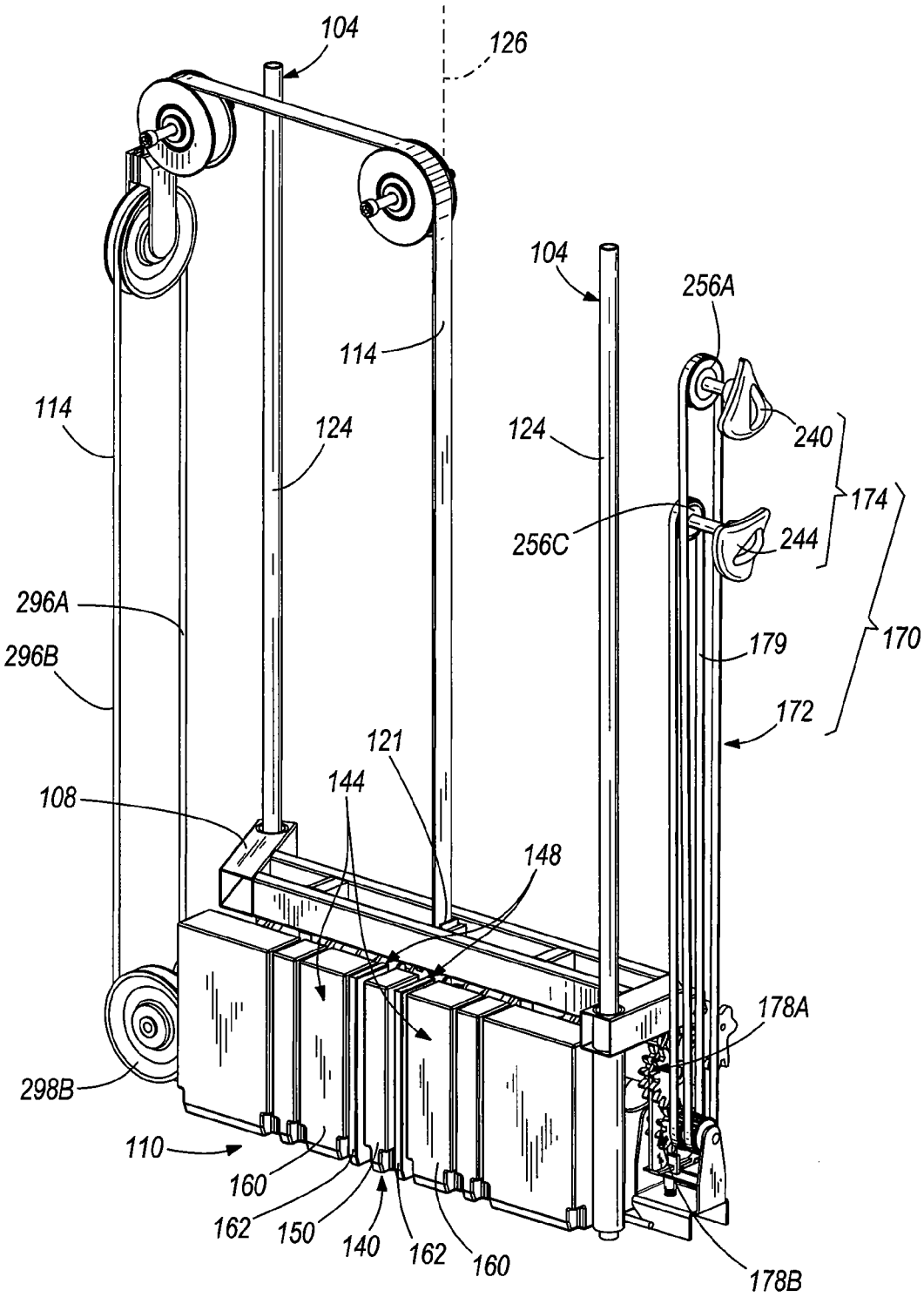
FIG. 2 is a perspective view of the resistance exercise apparatus of FIG. 1 with a portion removed for clarity.

As shown in FIG. 2, in the illustrated construction, the transmission assembly 114 is coupled to and drives the resistance support 108 at an input location 121 for movement relative to the guide 104 along a generally vertical axis 126. In this example, the guide 104 includes a pair of substantially parallel guide rods 124 extending vertically between end portions 122 of the apparatus frame 102. The resistance support 108 defines a pair of guide holes (not labeled) slidably receiving the guide rods 124. During an exercise, the resistance support 108 lifts selected portions of the resistance assembly 110, as described below in more detail.

It should be understood that the number of the guide rods could be different according to various requirements, and, thus, the guide 104 could include only one or more than two guide rods 124. It should also be understood that the guide 104 could be implemented as another structure. For example, the guide 104 could define a pair of guide slots, and the resistance support 108 could be arranged to be movable between such guide slots along the axis 126.

The resistance assembly 110 generally includes structure operable to apply resistance during exercise, e.g., a plurality of resisters each having a resistance. In the illustrated construction, the resistance of the resisters can be selectively and independently applied during an exercise. Also, the illustrated resisters are horizontally arranged and spaced, and each is arranged substantially symmetrically relative to the axis 126. With this horizontal arrangement, the weight stack may have a shorter overall stack height than a typical vertical weight stack, thus reducing the overall height of the resistance exercise apparatus 100. Also, with the symmetrical arrangement, the resistance support 108 has a reduced likelihood of binding on the guide rods 124.

The illustrated resistance assembly 110 includes five resisters, each including at least one resistance member (e.g., a weight plate). Only three of the five resisters will be described in detail as representatives to show features of the resistance assembly 110, and the three resisters are hereinafter referred to as a first resister 140, a second resister 144, and a third resister 148. It should be understood that "first", "second", and "third" are used herein for purpose of description only and could refer to any resister of the resistance assembly 110.

Figure 3:
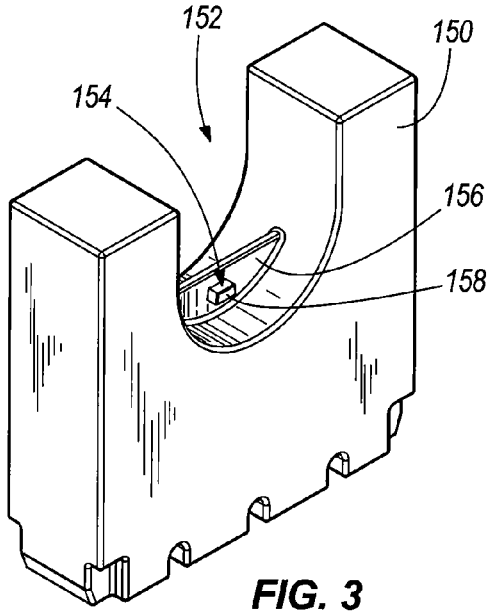
FIG. 3 is a perspective view of a weight member.

The first resister 140 includes a single first weight plate 150 disposed substantially symmetrically on the axis 126. As shown in FIG. 3, the first weight plate 150 defines a cutout 152 in a top portion with a latch feature 154 formed in the cutout 152. The illustrated latch feature 154 includes a rib 156 projecting from the first weight plate 150 into the cutout 152 and a knob or protrusion 158 formed on the rib 156.

As shown in FIG. 2, the second resister 144 includes two second weight plates 160. The two second weight plates 160 are disposed on opposite sides of the first weight plate 150 to be substantially symmetrical relative to the axis 126, and each have generally the same construction as the first weight plate 150 but, in the illustrated construction, have a different resistance (i.e., different weight).

Figure 4:
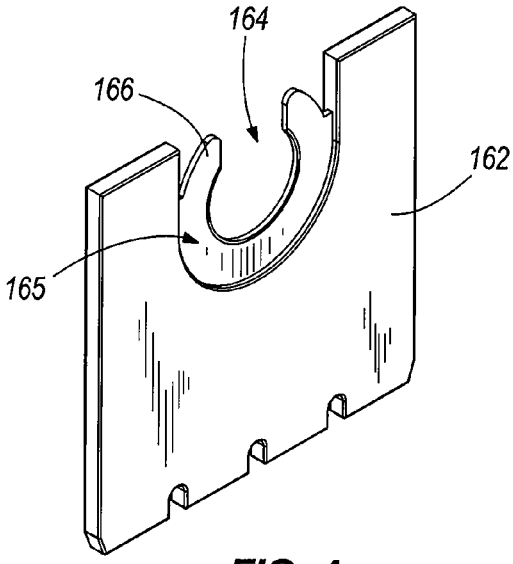
FIG. 4 is a perspective view of another weight member.

The third resister 148 includes two third weight plates 162. In the illustrated construction, the third weight plates 162 are disposed between the first weight plate 150 and the second weight plates 160 to be substantially symmetrical relative to the axis 126. As shown in FIG. 4, each third weight plate 162 defines a cutout 164 in a top portion with a latch feature 165 formed in the cutout 164. The illustrated latch feature 165 includes a hook 166 extending from the third weight plate 162 into the cutout 164.

While the first resister 140 includes a single weight plate 150, and the second and third resisters 144, 148 each include two weight plates 160, 162, respectively, it should be understood that each of the first, second and third resisters 140, 144, 148, and the other illustrated resisters, could have one, two or more weight plates. It is also to be understood that the number of the resisters of the resistance assembly 110 could be different according to various requirements, and, thus, the resistance assembly 110 could include more or fewer than five resisters.

In the example illustrated in FIG. 2, the third resister 148 has a relatively small resistance and, in the following description, is sometimes referred to as an "add-a-weight" resister. The remaining resisters, for example, the first and second resisters 140, 144, are sometimes referred to as "main weight" resisters. Therefore, in the example illustrated in FIG. 2, the resistance assembly 110 has four main weight resisters and one add-a-weight resister.

As shown in FIG. 2, the resistance exercise apparatus 100 further includes an adjustment assembly 170 engageable with the resistance assembly 110 to adjust the resistance to be applied by the resistance assembly 110 during an exercise. In the illustrated construction, the adjustment assembly 170 generally includes an adjustment mechanism 172 and a selector 174. The selector 174 is designed to allow a user to select a resistance. A mechanism 179 interconnects the selector 174 and the adjustment mechanism 172 to transfer motion between the selector 174 and the adjustment mechanism 172 in response to a user selection.

In the illustrated construction, the adjustment mechanism 172 generally includes a first selecting shaft 176 (shown in FIG. 5), a second selecting shaft 177 (shown in FIG. 6), a resistance gear assembly 178A operable to rotate the first selecting shaft 176 and the second selecting shaft 177, and an adjustment gear assembly 178B engageable with the resistance gear assembly 178A.

Figure 5:
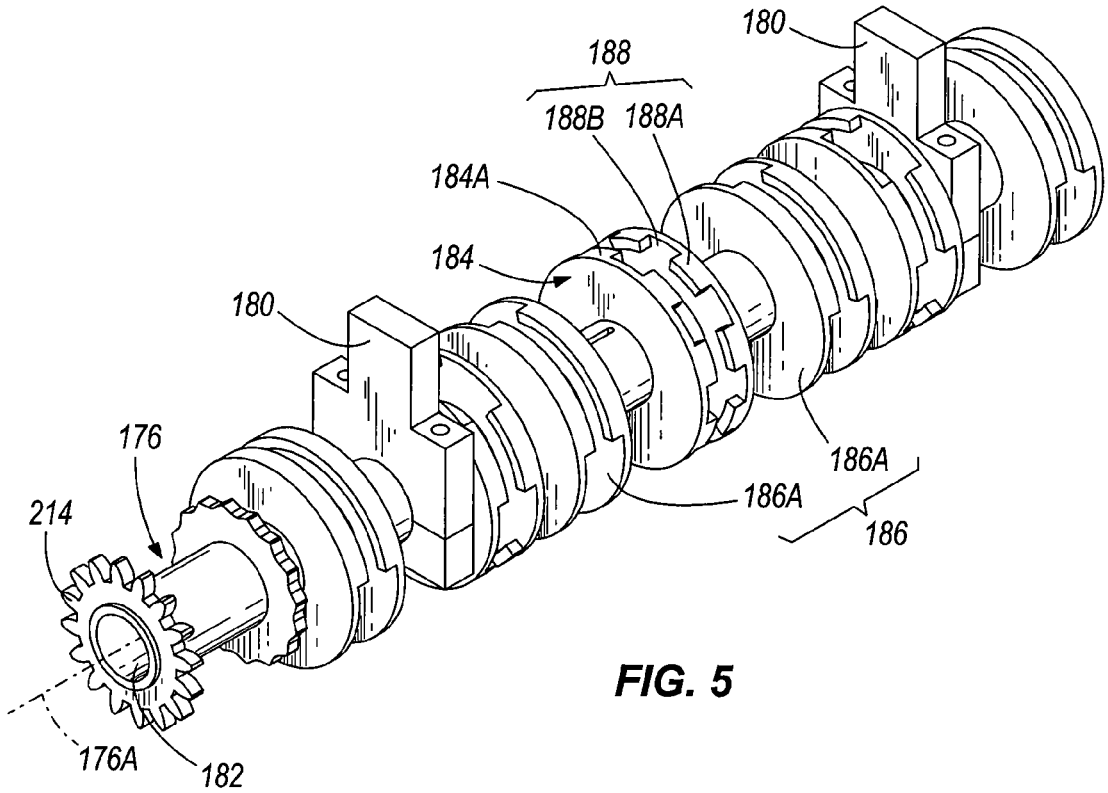
FIG. 5 is a perspective view of a first selecting shaft.

Referring to FIG. 5, the first selecting shaft 176 extends along and is rotatable about a first shaft axis 176A. A pair of shaft mounts 180 rotatably mount the first selecting shaft 176 to an underside of the resistance support 108. An inner bore 182 is defined through the first selecting shaft 176 along the first shaft axis 176A to receive the second selecting shaft 177, as described below in more detail.

A plurality of weight selector discs or resistance member catches are supported on the first selecting shaft 176, in positions corresponding to the main weight resisters, and are rotatable with the first selecting shaft 176. As shown in FIG. 5, four catches are symmetrically arranged along the first shaft axis 176A, each corresponding to one of the four main weight resisters (i.e. the first resister 140, the second resister 144, etc.). Specifically, a first catch 184 and a second catch 186 correspond to the first resister 140 and the second resister 144. A first catch member 184A corresponds to the first weight plate 150 of the first resister 140. Second catch members 186A correspond to the second weight plates 160 of the second resister 144, respectively.

Each of the catch members is formed with one or more catch features engageable with the latch feature of the corresponding weight plate. In the example illustrated in FIG. 5, each catch includes a pair of spaced and parallel catch discs. Catch features 188 of the first catch member 184A include protrusion portions 188A with opening portions 188B alternating around the catch disc in a pre-selected pattern. When the first catch member 184A is in a rotated position such that one of the protrusion portions 188A is located beneath the latch feature 154 (i.e., protrusion 158) of the first weight plate 150, the first catch member 184A will engage the first weight plate 150. When the first catch member 184A is in another rotated position such that one of the opening portions 188B is located beneath the latch feature 154 (i.e., protrusion 158) of the first weight plate 150, the first catch member 184A will not engage the first weight plate 150.

The second catch members 186A and the other catches include one or more protrusion portions with opening portions arranged in a given pattern to form the catch features that selectively engage or do not engage the other main resisters in the similar manner. Accordingly, the catches selectively engage the weight plates of the main weight resisters by indexing the catch feature to a position corresponding to the latch feature on the weight plates. Conversely, by indexing the opening portions to a position beneath the latch feature on the weight plates, the catches do not engage the weight plates of the main weight resisters. Rotating the first selecting shaft 176 to one of a plurality of index points causes the catches to engage or to not engage the main weight resisters in a preset pattern, thus changing the number of main weight plates and the total resistance selected. In the example illustrated in FIG. 5, the catches on the first selecting shaft 176 has sixteen rotated positions (corresponding to the index points) that may be utilized to pick up the main weight resisters.

Figures 17, 18:
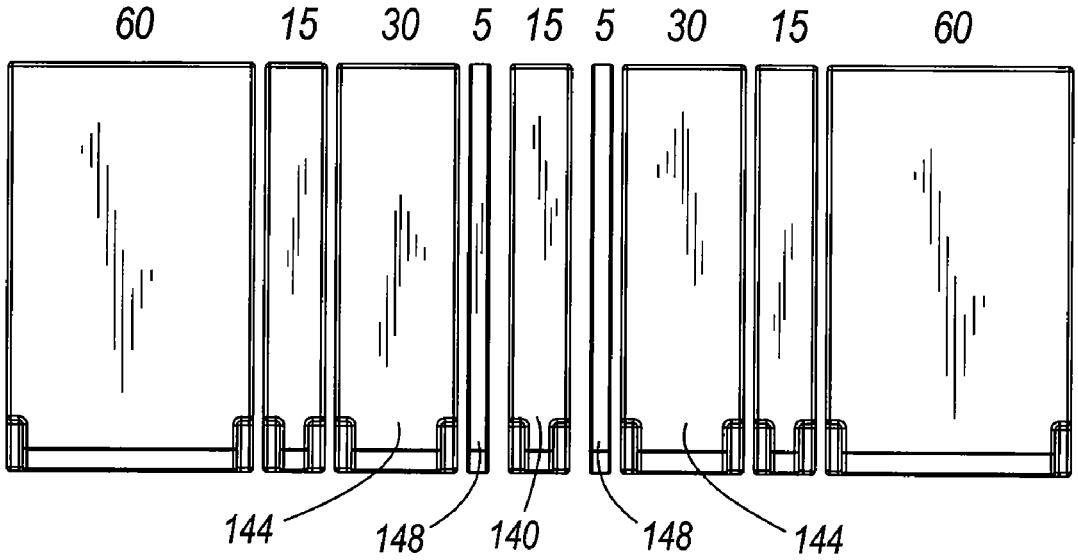
FIG. 17 illustrates the arrangement of the weight stack of the apparatus in FIG. 1.
FIG. 18 is a table showing various resistance settings based on the weight stack arrangement of FIG. 17.

As described in more detail below, FIGS. 17-18 illustrate the pattern for each catch member to engage or not engage the respective weight plate. For example, the first catch member 184A engages the first weight plate 150 in positions 2, 4, 6, 8, 10, 12, 14 and 16 and does not engage the first weight plate 150 in positions 1, 3, 5, 7, 9, 11, 13 and 15.

Figure 6:
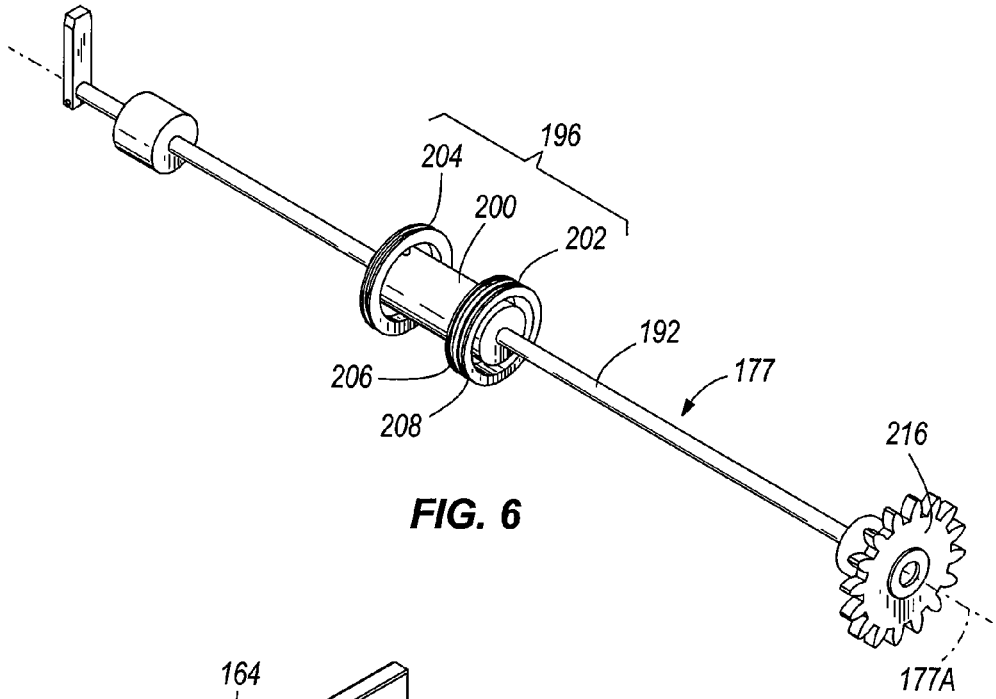
FIG. 6 is a perspective view of a second selecting shaft.

Referring to FIG. 6, the second selecting shaft 177 extends along and is rotatable about a second shaft axis 177A. The second selecting shaft 177 is rotatably received in the inner bore 182 of the first selecting shaft 176 and includes a screw shaft portion 192. The second selecting shaft 177 is arranged to be substantially coaxial with the first selecting shaft 176, and, therefore, the first shaft axis 176A is aligned with the second shaft axis 177A. A third catch 196, configured to be a vertically-fixed acme nut, threadingly engages the screw shaft portion 192 such that the third catch 196 moves axially along the second shaft axis 177A upon rotation of the second selecting shaft 177.

The third catch 196 includes a plug or third catch support 200 threadingly engaging the screw shaft portion 192 of the second selecting shaft 177 and a plurality of third catch members supported on the third catch support 200. Referring to FIG. 6, one third catch member 202 corresponds to one of the third weight plates 162 of the add-a-weight resister 148, and the other third catch member 204 corresponds to the other third weight plate 162 of the add-a-weight resister 148.

In the illustrated construction, the one third catch member 202 is about twice as wide as the other third catch member 204, and includes two catch member portions, a left catch member portion 206 and a right catch member portion 208. In this example, the third catch members 202 and 204 are illustrated as catch rings. As the second selecting shaft 177 rotates, the third catch 196 will translate back and forth so that the third catch members 202 and 204 will engage the hook 166 of the latch feature 165 of the third weight plates 162 to "add a weight" and increase the resistance of the system.

As the third catch support 200 slides to the left, the one third catch member 202 engages its corresponding third weight plate 162 with the left catch member portion 206, while the other third catch member 204 does not engage its corresponding third weight plate 162. As the third catch support 200 slides further to the left, the one third catch member 202 engages its corresponding third weight plate 162 with the right catch member portion 208, and the other third catch member 204 engages its corresponding third weight plate 162, so that both add-a-weights are engaged. In this example, the second selecting shaft 177 has a first rotated position (a "default" position), in which no additional resistance of the add-a-weight resister 148 is selected, a second position, in which a portion of the add-a-weight resister 148 (only one third weight plate 162) is selected, and a third position, in which the whole add-a-weight resister 148 (both third weight plates 162) is selected.

Figure 7:
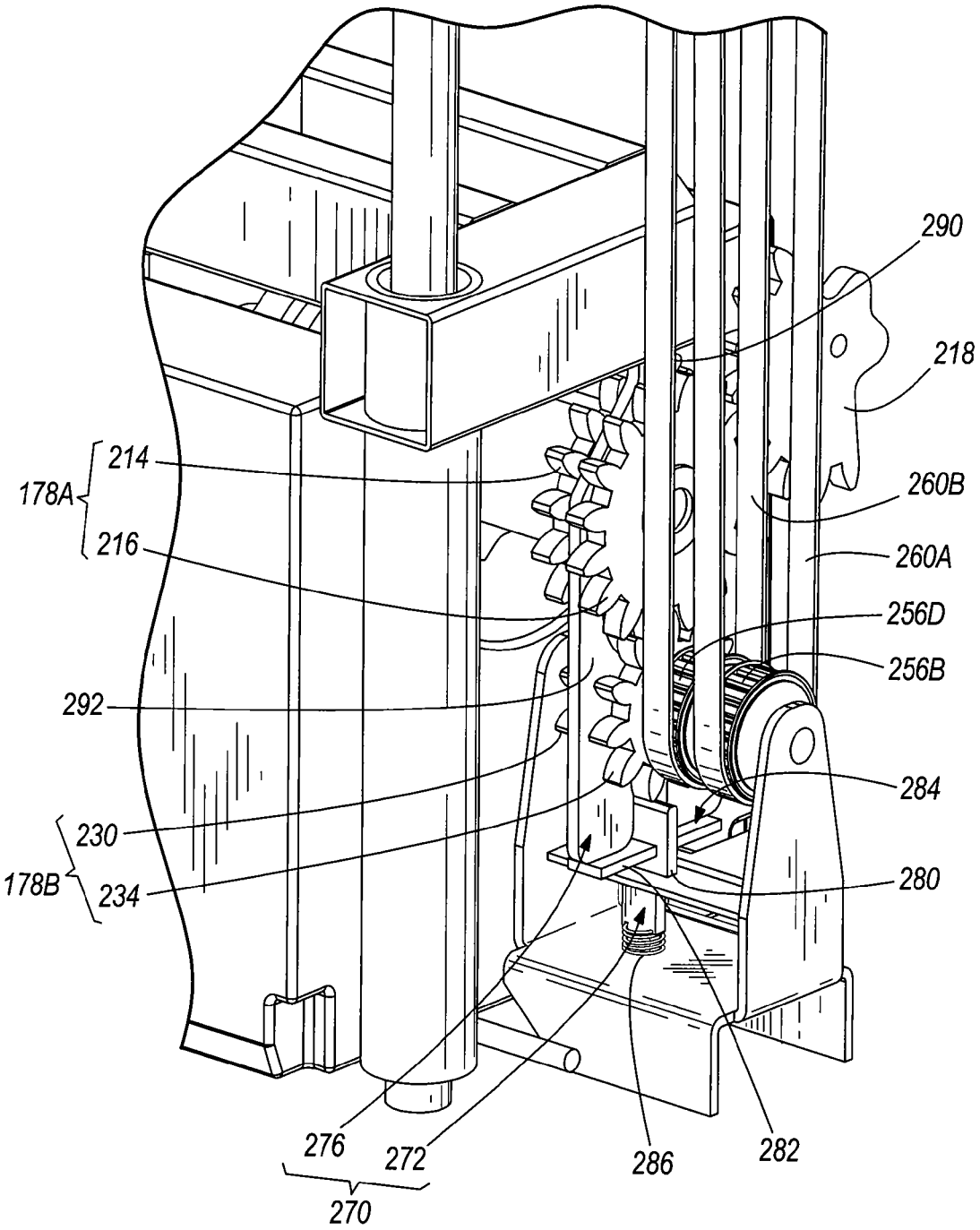
FIG. 7 is a perspective view of a portion of the resistance exercise apparatus, illustrating operation of gear assemblies and an interlock assembly.

As shown in FIG. 7, the resistance gear assembly 178A generally includes a first resistance gear 214, a second resistance gear 216 and, optionally, a partial (e.g., "half") gear 218. The first resistance gear 214 is drivingly attached to an end of the first selecting shaft 176 (shown in FIG. 5) and is designed to rotate the first selecting shaft 176. The first resistance gear 214 has sixteen teeth (corresponding to the sixteen rotated positions of the first selecting shaft 176) in order to facilitate the selection of the resistance position of the first selecting shaft 176.

The second resistance gear 216 is drivingly attached to an end of the second selecting shaft 177 (shown in FIG. 6) and is designed to rotate the second selecting shaft 177. The half gear 218 is designed to limit rotation of the second selecting shaft 177 beyond the first position and the third position. Between the first position and the third position, the half gear 218 rotates, allowing the second resistance gear 216 and the second selecting shaft 177 to rotate. When trying to rotate beyond the first position or beyond the third position, a half gear stop (not shown) is engaged so that the half gear 218 cannot rotate. As such, rotation of the second resistance gear 216 and of the second selecting shaft 177 are similarly restricted.

The adjustment gear assembly 178B is drivingly engageable with the resistance gear assembly 178A. The adjustment gear assembly 178B includes a first adjustment gear 230 engageable with the first resistance gear 214 and a second adjustment gear 234 engageable with the second resistance gear 216.

Figure 8:
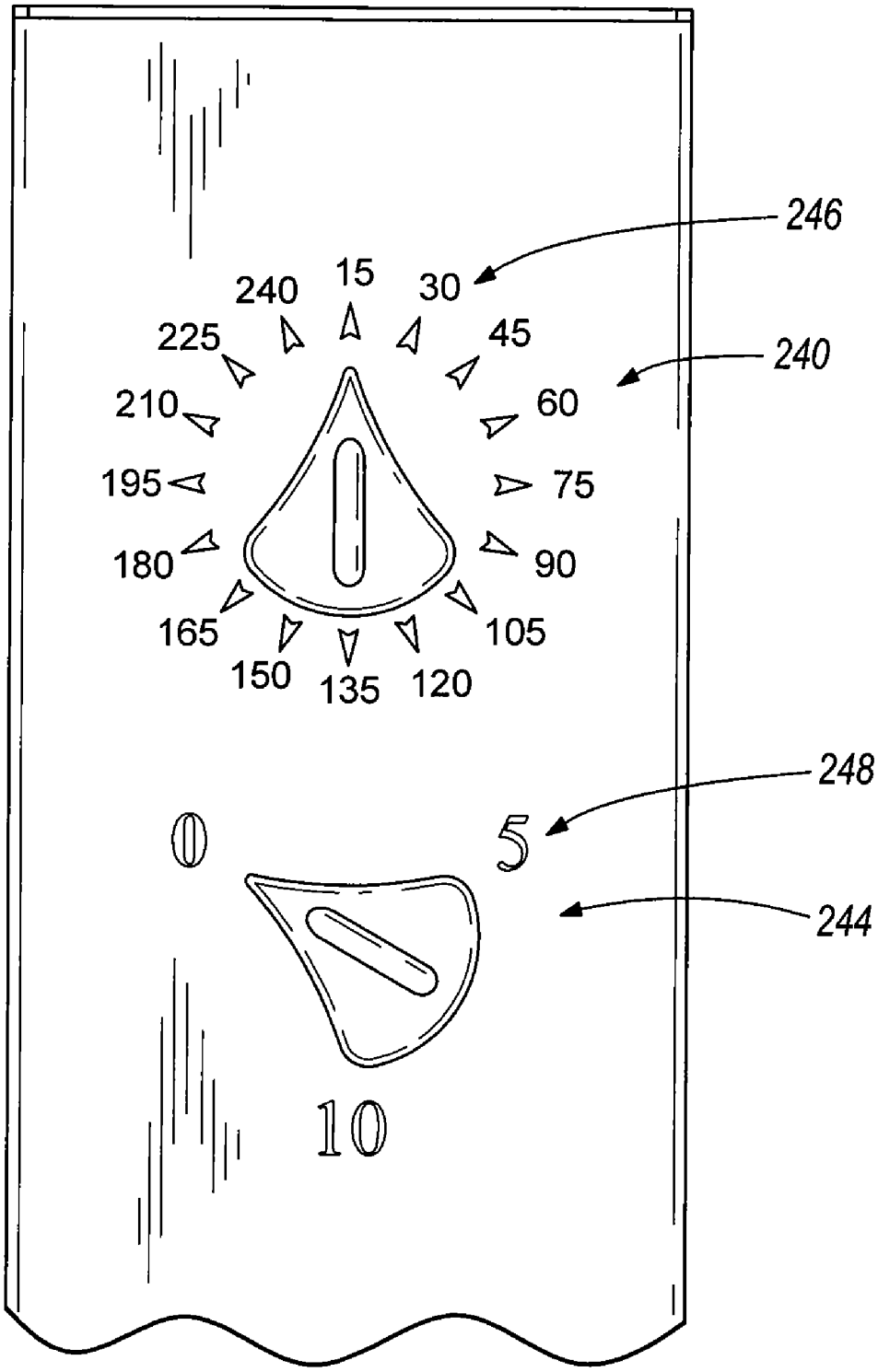
FIG. 8 is illustrates a selector for selecting the desired weight.

In the illustrated construction, the selector 174 (FIG. 2) is mounted on the side frame portion 120 at an ergonomically preferred location, for example, at about waist level, so that the user does not have to bend down to make a selection. As shown in FIG. 8, the selector 174 includes a first selector 240, operable to select resistance to be provided by the main resisters, and a second selector 244, operable to select resistance to be provided by the add-a-weight resister 148. The first selector 240 and the second selector 244 are interconnected to the first adjustment gear 230 and the second adjustment gear 234, respectively, through the interconnecting mechanism 179 (FIG. 2) such that rotation of each of the first adjustment gear 230 and the second adjustment gear 234 is synchronized with rotation of the first selector 240 and the second selector 244, respectively, in response to a user selection. The first selector 240 and the second selector 244 may be, for example, selector knobs or selector dials, and resistance selection is controlled by turning the first selector 240 and/or the second selector 244.

With continued reference to FIG. 8 the selector 174 further includes an indicator for intuitive use of the resistance exercise apparatus 100. The indicator includes a first indicator 246, facilitating selection of the main resistance, and a second indicator 248, facilitating selection of the add-a-weight resistance. The first indicator 246 includes a plurality of resistance-indicating numbers and arrows that are arranged around and cooperate with the pointed end of the first selector 240 to indicate the selected main resistance. The second indicator 248 includes a plurality of resistance-indicating numbers that are arranged around the second selector 244 to indicate the selected add-a-weight resistance.

In the illustrated construction, the resistance range is from fifteen to two hundred forty pounds, plus two five-pound add-a-weights (here, each of the third weight plates 162 has a weight of five pounds). The first selector 240 has a continuous 360° rotation with sixteen positions corresponding to the sixteen rotated positions of the first selecting shaft 176. The second selector 244 rotates through about 240° and has three positions: the "Zero" position is set as a default position and corresponds to the first rotated position of the second selecting shaft 177, in which no add-a-weight resistance is selected; the "5" pounds position corresponds to the second rotated position of the second selecting shaft 177, in which only the one third weight plate 162 is selected; and the "10" pounds position corresponds to the third rotated position of the second selecting shaft 177, in which both third weight plates 162 are selected.

The interconnecting mechanism 179 generally includes belt and pulley assemblies. As shown in FIGS. 2 and 7, one pair of pulleys 256A and 256B are mounted with the first selector 240 and the first adjustment gear 230, respectively, and one belt 260A interconnects the pulleys 256A/256B.

Another pair of pulleys 256C and 256D are mounted with the second selector 244 and the second adjustment gear 234, respectively, and another belt 260B interconnects the pulleys 256C/256D.

It should be understood that other methods and components could be used to interconnect the selectors 240 and 244 and the adjustment gears 230 and 234, such as, for example, flexible drive shafts, manual cabled actuators, electrical actuators, etc. In comparison with conventional systems, the arrangement of the adjustment assembly 170 of this example makes it possible to substantially enclose the resistance assembly 110. Also, the arrangement of the adjustment assembly 170 makes it possible to remotely position the selector 174, for example, in a more ergonomic position for the user.

An interlock assembly 270 operates to ensure that selection of resistance and adjustment of the adjustment assembly 170 is allowed only when the resistance assembly 110 is in the resting position. Referring to FIG. 7, the interlock assembly 270 generally includes an adjustment gear lock assembly 272 and a resistance gear lock assembly 276. The adjustment gear lock assembly 272 includes an adjustment gear pin 280, a pin support 282, supporting the adjustment gear pin 280 and having a pin support surface 284, and a biasing member 286, such as, for example, a spring 286 attached to the adjustment gear pin 280.

Figure 9:
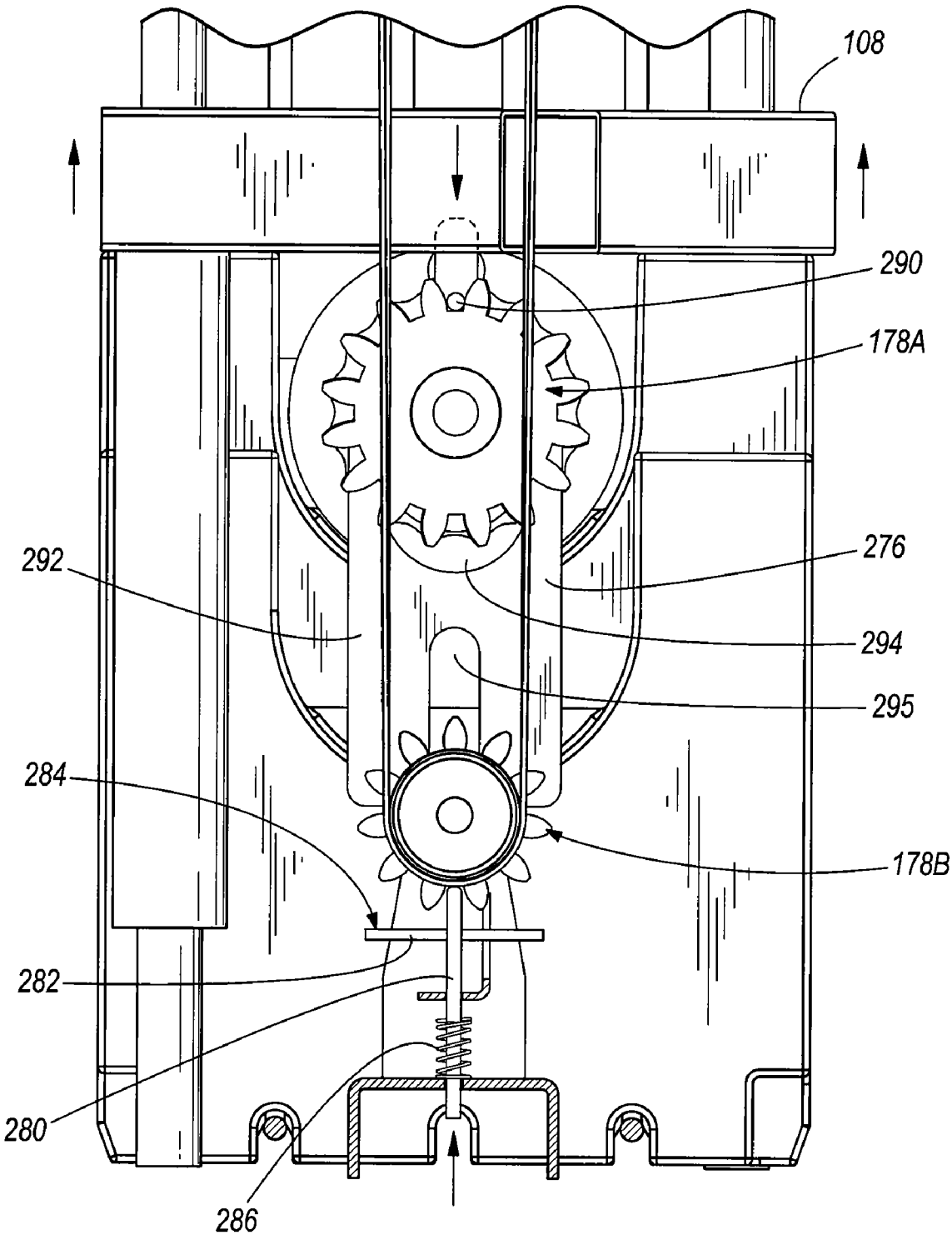
FIG. 9 is a front view of the interlock assembly in a locked position.

Referring to FIG. 9, the spring 286 is operable to bias the adjustment gear pin 280 into engagement, in a locking position, between gear teeth of the adjustment gear assembly 178B to substantially prevent rotation of the adjustment gear assembly 178B from a resistance setting orientation when the resistance gear assembly 178A and the adjustment gear assembly 178B are disengaged. In this condition, illustrated in FIG. 9, the resistance selection adjustment is not allowed.

The resistance gear lock assembly 276 includes a pin 290 and a pin support bracket or plate 292 on which the pin 290 is supported. The pin support plate 292 is disposed between the first resistance gear 214 and the second resistance gear 216. The pin support plate 292 has a center opening 294 allowing the first selecting shaft 176 and/or the second selecting shaft 177 to extend therethrough and an axial slot 295 defined at a bottom section thereof. The opening 294 and the slot 295 allow vertical sliding of the pin support plate 292 between the first adjustment gear 230 and the second adjustment gear 234 as the resistance support 108 moves between the resting position and the exercise position. A shaft supporting the first adjustment gear 230 and the second adjustment gear 234 is positionable in the axial slot 295 to prevent rotation of the pin support plate 292.

The center opening 294 is shaped to be substantially oval such that the pin support plate 292 together with the pin 290 is movable vertically relative to the resistance gear assembly 178A. The pin 290 is movable by gravity from an unlocking position to a locking position, when the resistance gear assembly 178A and the adjustment gear assembly 178B are disengaged, so as to be engageable between gear teeth of the resistance gear assembly 178A. In the locking position, the pin 290 substantially prevents rotation of the resistance gear assembly 178A from a resistance setting orientation.

Figure 10:
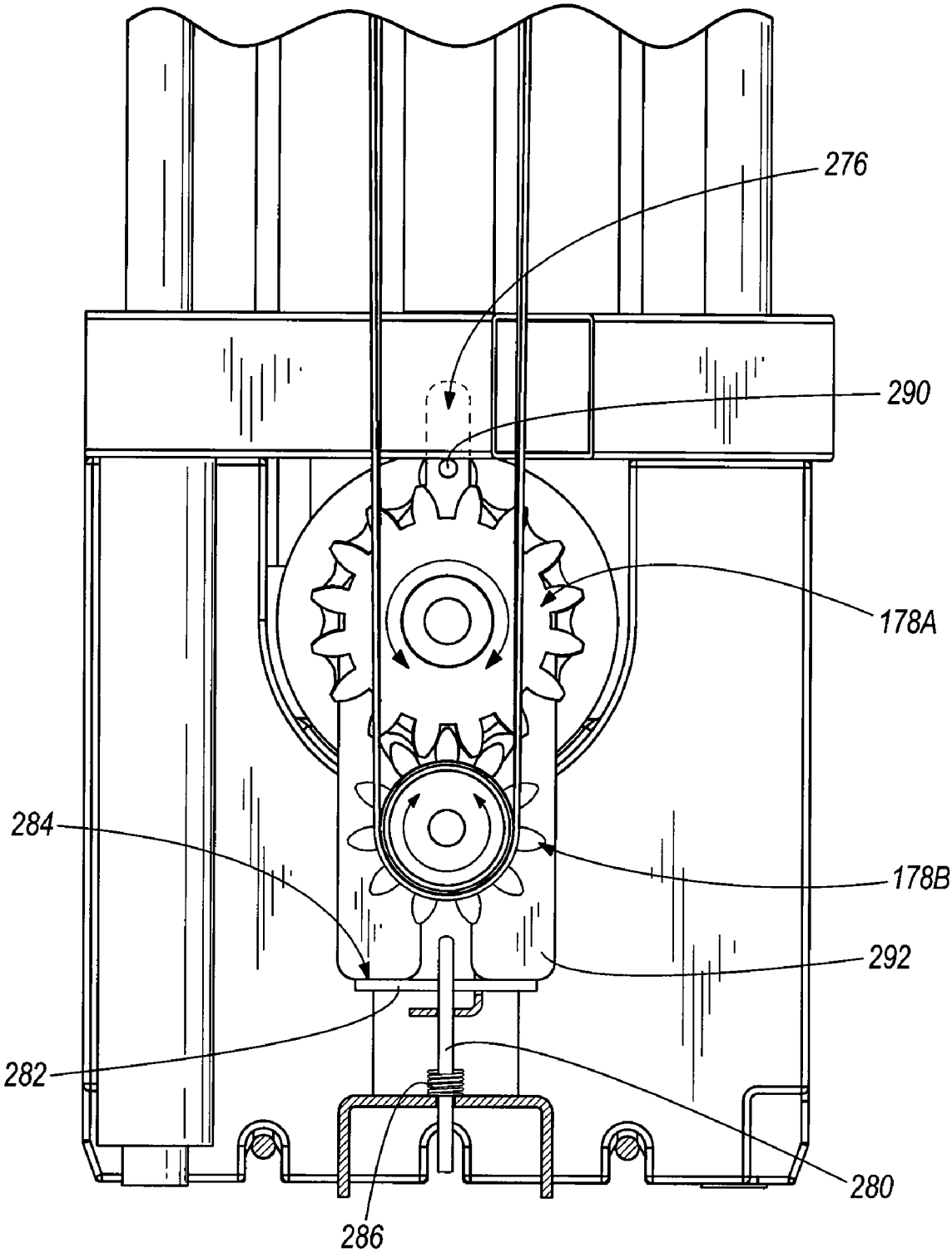
FIG. 10 is a front view of the interlock assembly in an unlocked position.

Referring to FIG. 10, as the resistance gear assembly 178A engages the adjustment gear assembly 178B, the bottom of the pin support plate 292 is engageable with the pin support surface 284 of the pin support 282 to move the adjustment gear pin 280 from its locking position (FIG. 9) toward its unlocking position (FIG. 10). Simultaneously, the pin 290 of the resistance gear lock assembly 276 is moved by this engagement relative to the resistance gear assembly 178A from its locking position (FIG. 9) toward its unlocking position (FIG. 10). In this condition, adjustment of the resistance selection is allowed.

Figure 11:
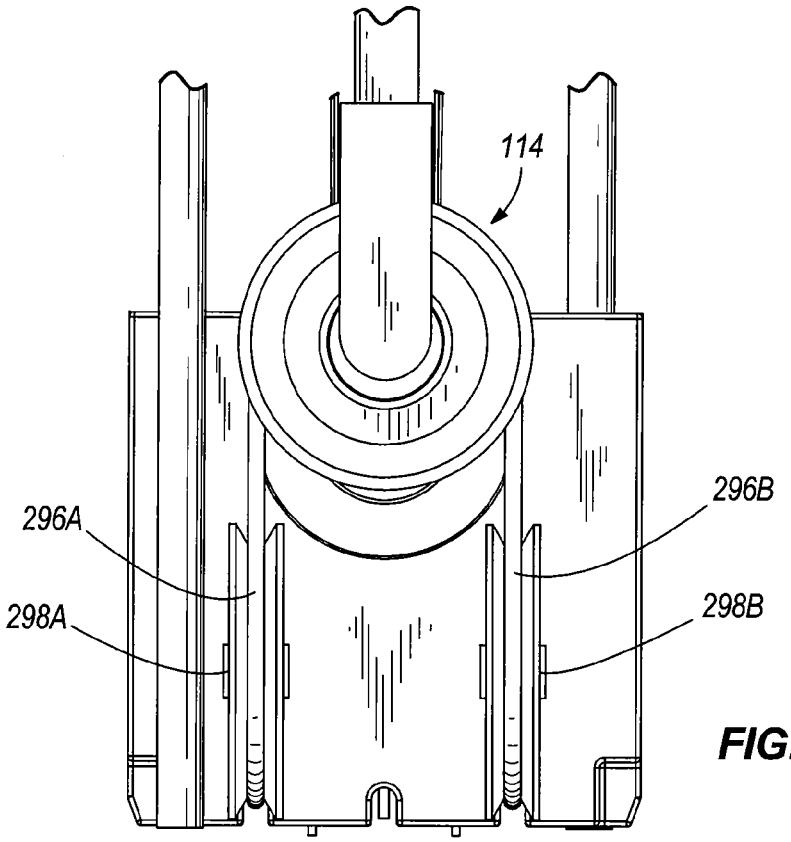
FIG. 11 illustrates the resistance exercise apparatus, showing a dual-output transmission assembly.

The transmission drive assembly 114 may be capable of single output, dual outputs or multiple outputs. In the example illustrated in FIG. 11, the transmission drive assembly 114 is a dual-output design. A first cable section 296A of a cable changes its direction through a first pulley 298A and extends outwardly, and a second cable section 296B of the cable changes its direction through a second pulley 298B and extends outwardly. The first cable section 296A and the second cable section 296B are then connected to exercise portions allowing for, for example, leg-driven exercise, arm-driven exercise, etc.

Figure 12A:
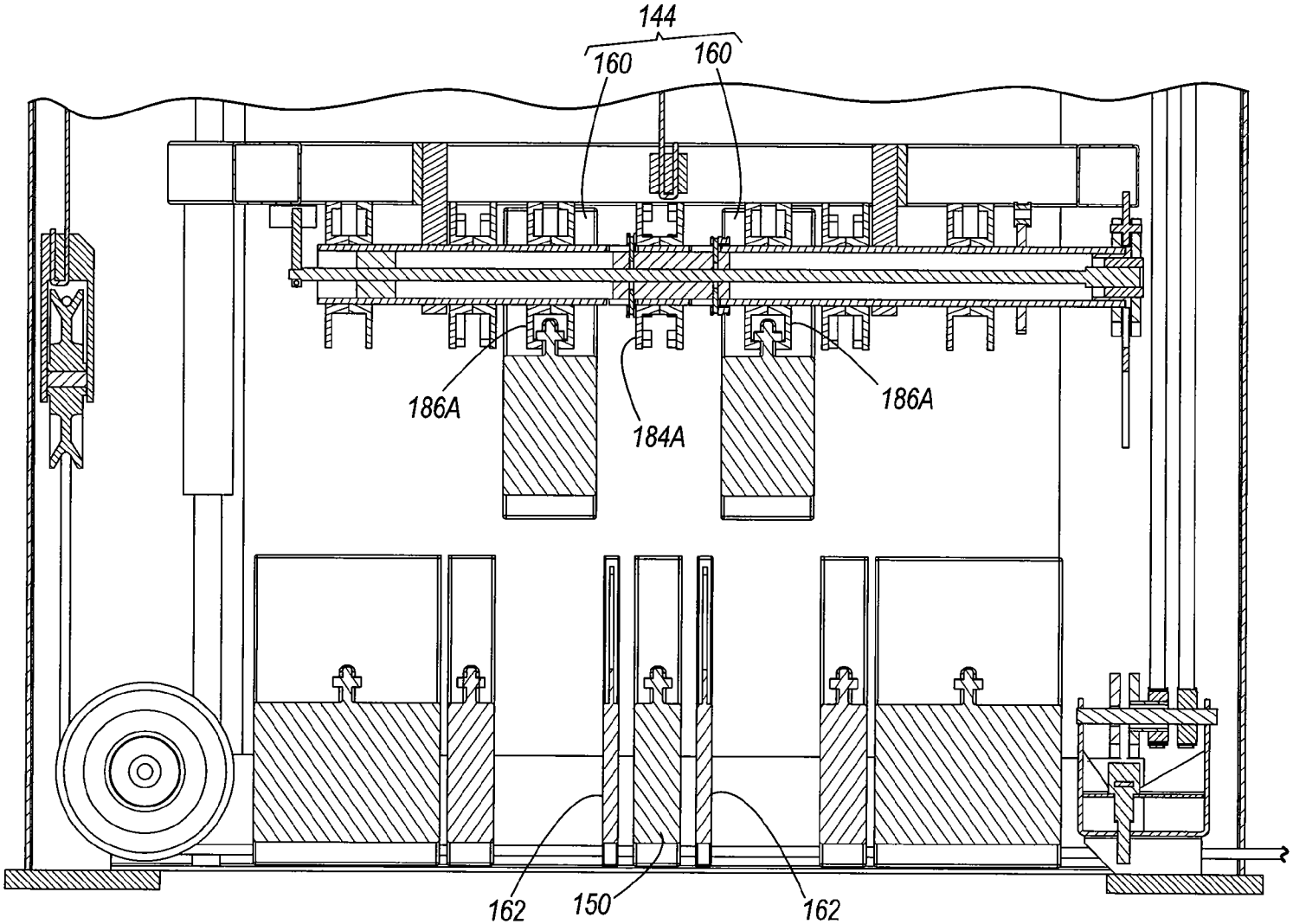
FIG. 12A is a cross-sectional view illustrating an exercising condition of the resistance exercise apparatus.
Figure 12B:
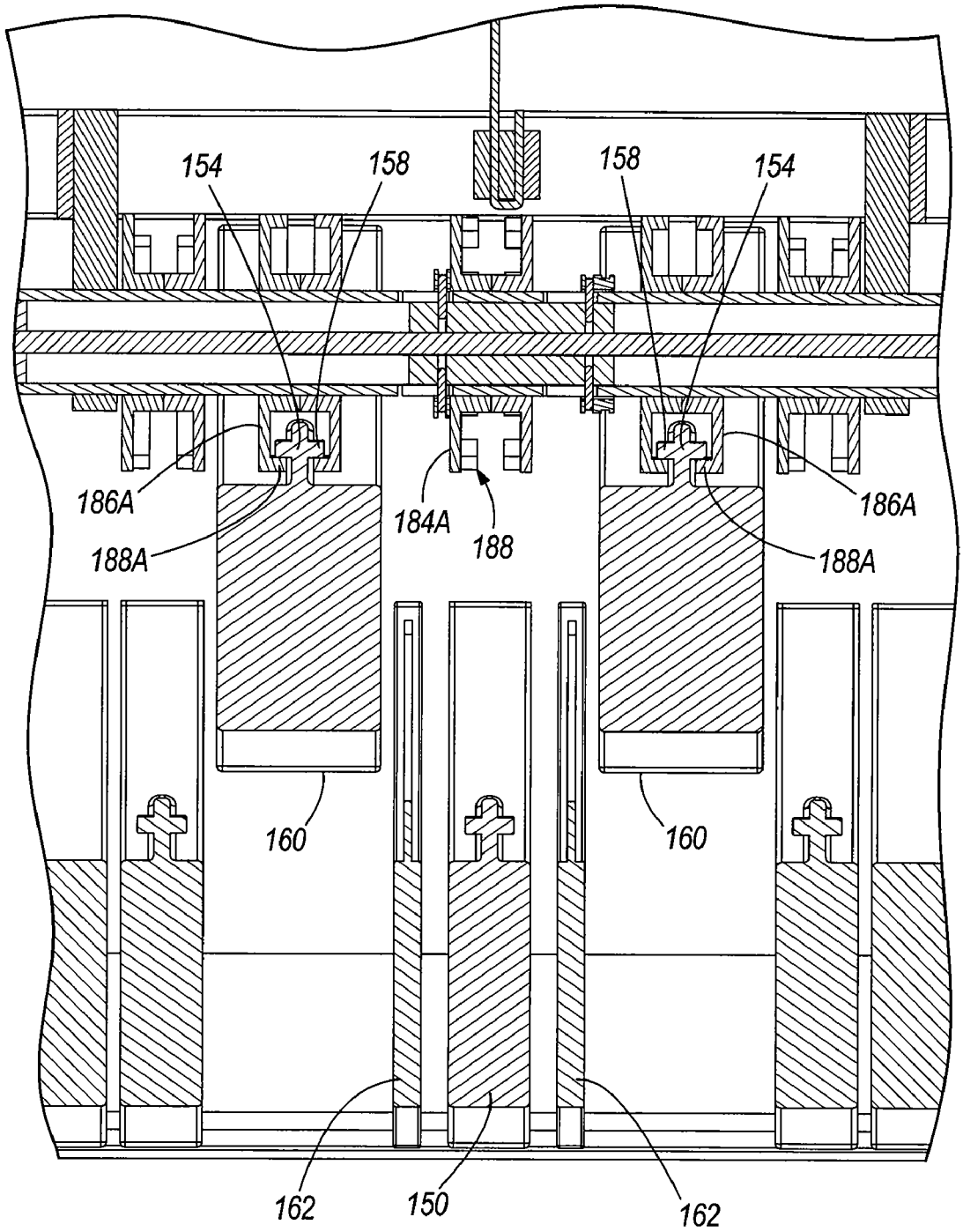
FIG. 12B is an enlarged view of a portion of the resistance exercise apparatus shown in FIG. 12A.

Operation of the resistance exercise apparatus 100 will be described in the following with reference to FIGS. 12 through 16 and in accordance with the example illustrated in FIGS. 17-18 described in more detail below. FIGS. 12A and 12B illustrate the resistance selection in which only the second weight plates 160 of the second main weight resister 144 is lifted (e.g., two thirty-pound weight plates+the Tare weight=seventy-five pounds). To achieve this, with the weights in the resting position (FIG. 10), the first selector 240 is rotated to "75". In this position, the first selecting shaft 176 positions the main resister catches such that only the second catch 186 is positioned in an orientation in which the protrusion portions 188A on the second catch members 186A engage the latch features 154 (i.e., protrusions 158) on the second weight plates 160, respectively. The other main resister catches are positioned in an orientation in which the opening portions 188B on the other catches are positioned beneath the latch features on the weight plates of the other resisters.

Figure 13A:
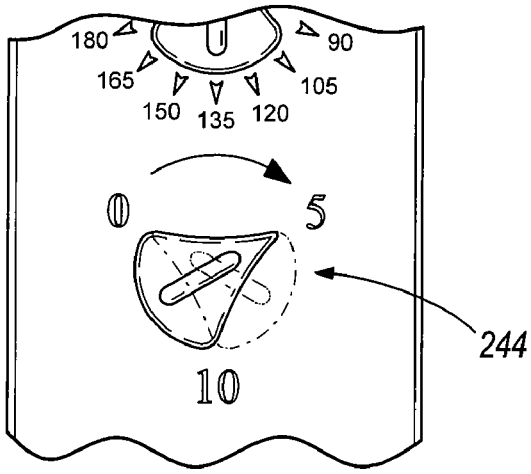
FIG. 13A is a view showing a five-pound add-a-weight being selected.
Figure 13B:
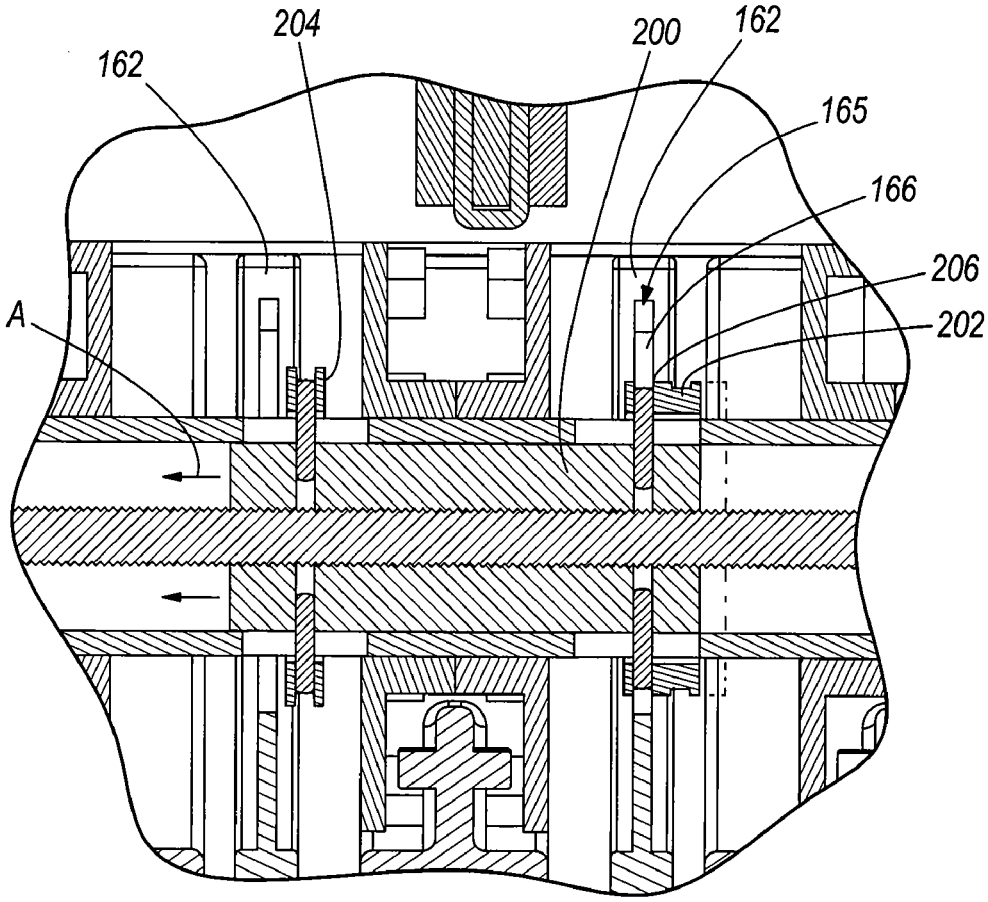
FIG. 13B is a cross-sectional view illustrating selection movement of the second selecting shaft in response to the five-pound weight selection of FIG. 13A.
Figure 14A:
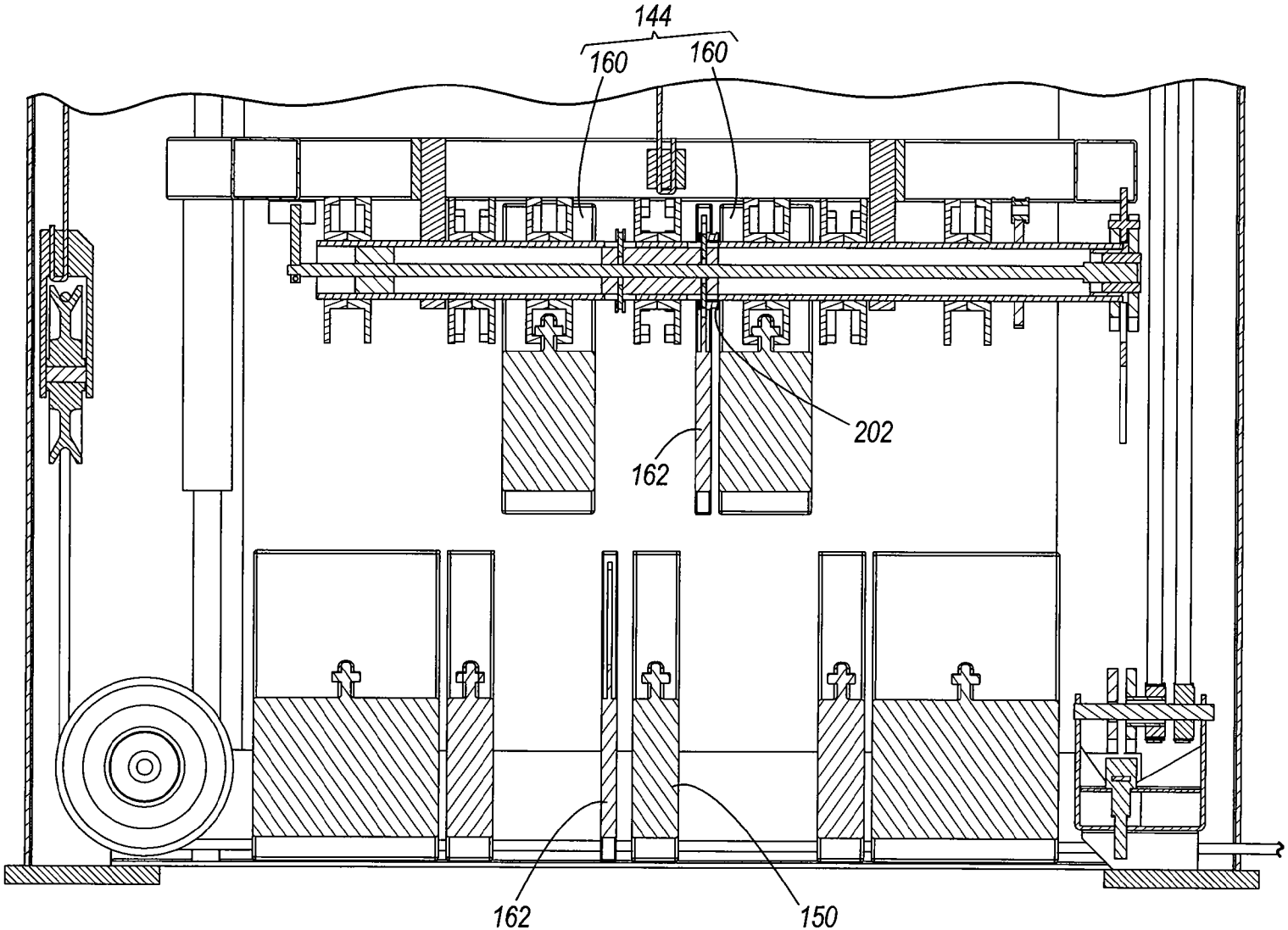
FIG. 14A is a cross-sectional view illustrating another exercising condition of the resistance exercise apparatus.
Figure 14B:
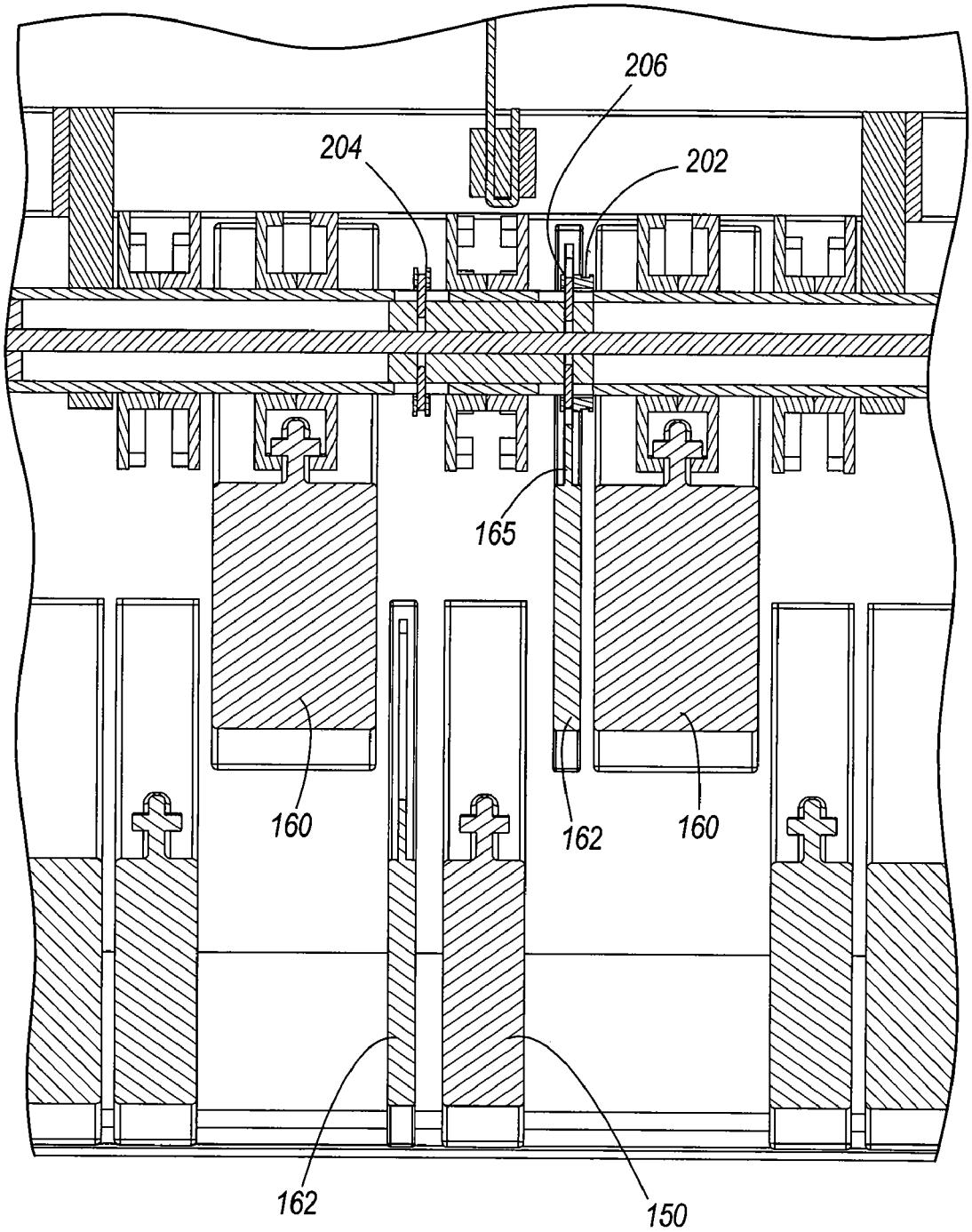
FIG. 14B is an enlarged view of a portion of the resistance exercise apparatus shown in FIG. 14A.

Referring to FIG. 13A, if the user wants to add five pounds of weight, the weights are returned to the resting position (FIG. 10), and the second selector 244 is turned to the "5" position. Referring to FIG. 13B, in response to the five-pound selection, the third catch support 200 is moved to the left (as indicated by the arrow A) by the adjustment assembly 170 such that the left catch member portion 206 of the one third catch member 202 is aligned with the latch feature 165 (i.e., hook 166) of its corresponding third weight plate 162. Referring to FIGS. 14A and 14B, when the user's force is applied on the exercise portion to perform the exercise, the second main resister 144 plus a portion of the add-a-weight resister 148 (i.e., only the one third weight plate 162) is lifted (e.g., two thirty-pound weight plates+the Tare weight+one five-pound weight plate=eighty pounds).

Figure 15A:
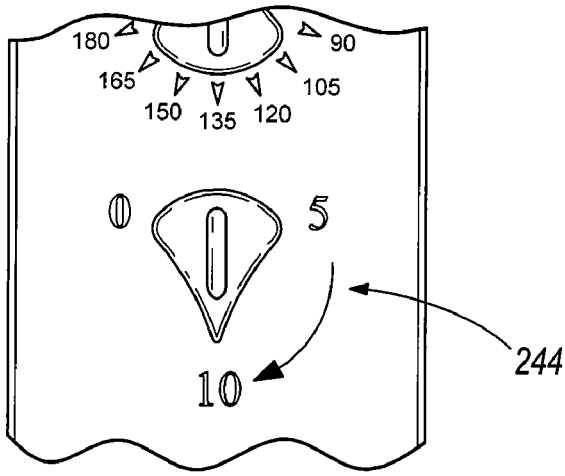
FIG. 15A is a view showing a ten-pound add-a-weight being selected.
Figure 15B:
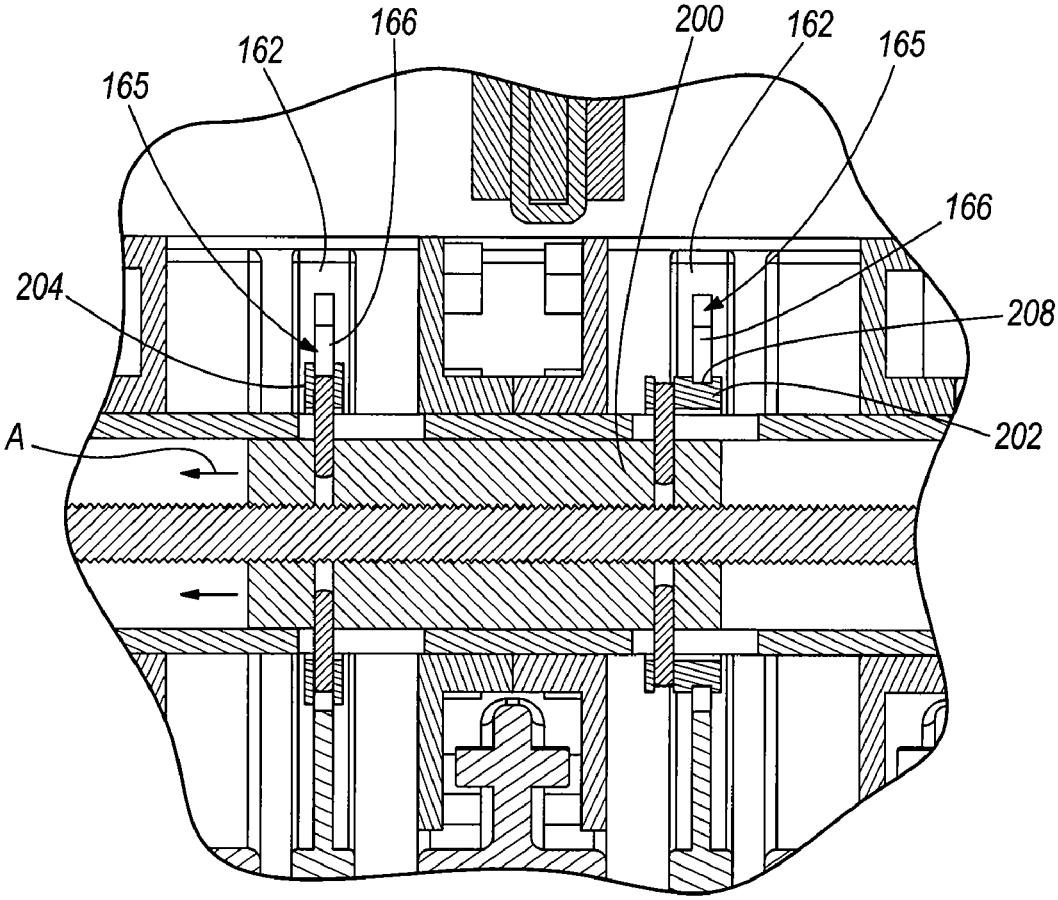
FIG. 15B is a cross-sectional view illustrating selection movement of the another selecting shaft in response to the ten-pound weight selection of FIG. 15A.
Figure 16A:
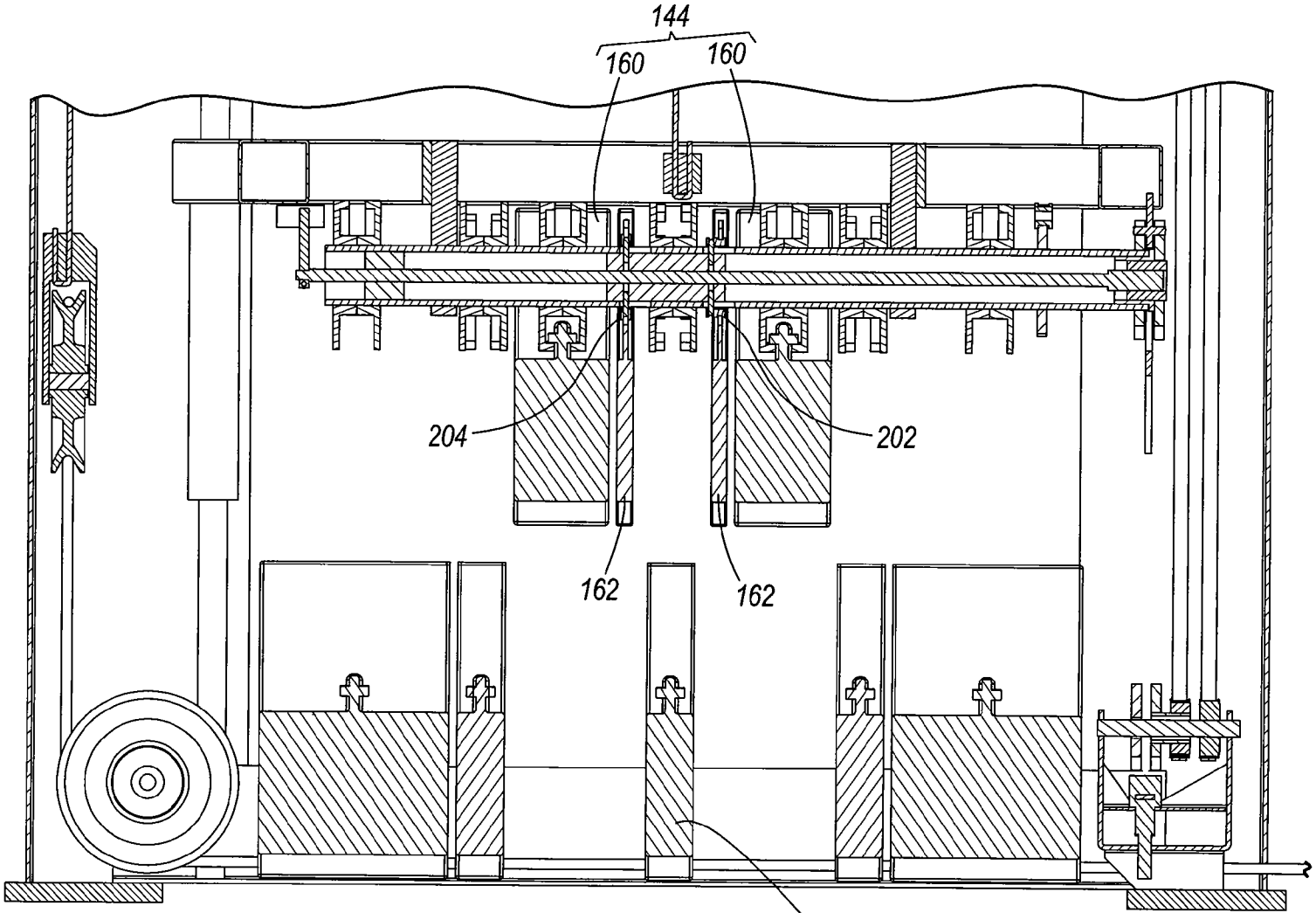
FIG. 16A is a cross-sectional view illustrating a further exercising condition of the resistance exercise apparatus.
Figure 16B:
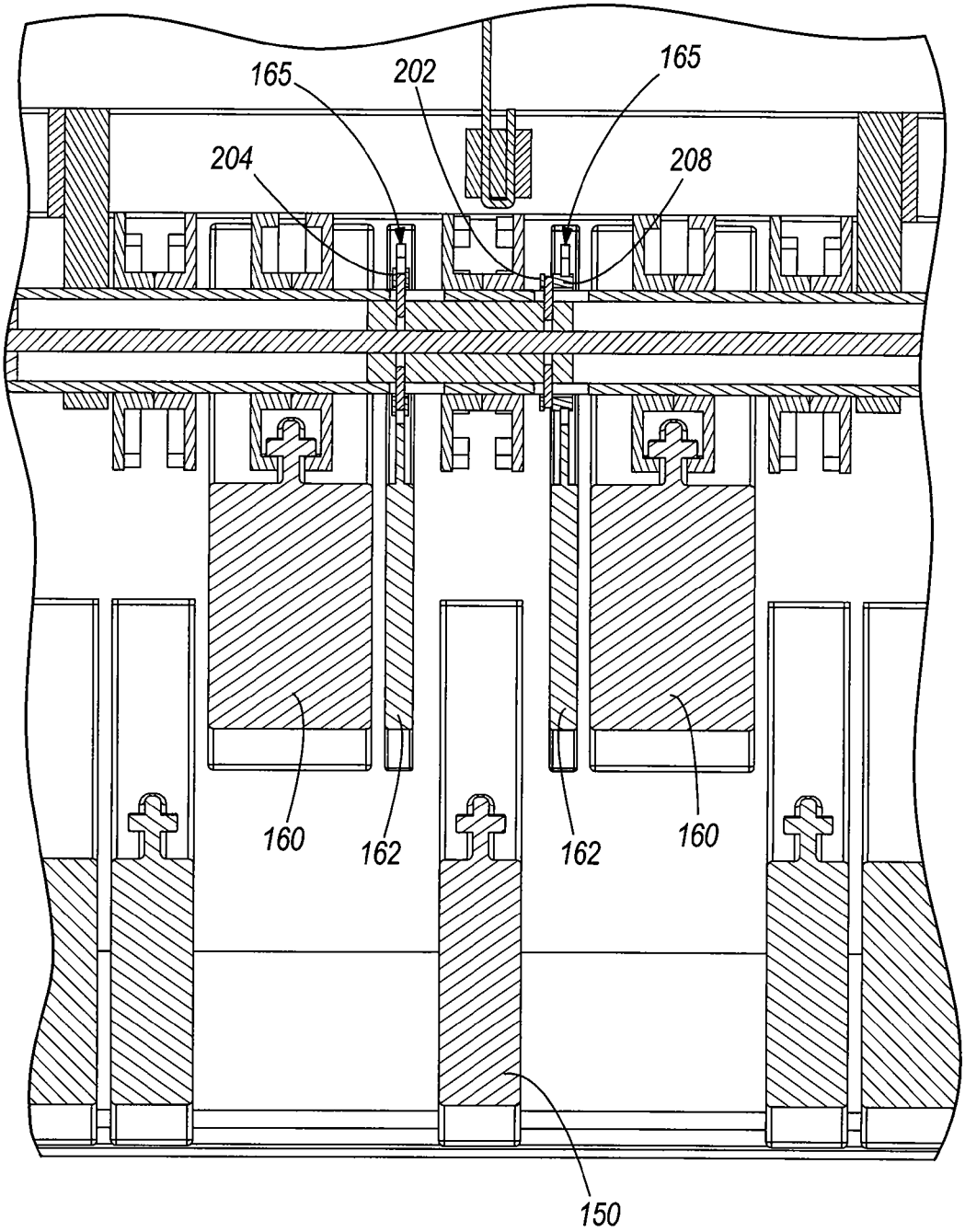
FIG. 16B is an enlarged view of a portion of the resistance exercise apparatus shown in FIG. 16A.

Referring to FIG. 15A, if the user wants to add ten pounds of weight, the weights are returned to the resting position (FIG. 10), and the second selector 244 is turned to the "10" position. Referring to FIG. 15B, in response to the ten-pound selection, the third catch support 200 is moved further to the left (as indicated by the arrow A) by the adjustment assembly 170 such that the right catch member portion 208 of the one catch member 202 is aligned with the latch feature 165 (i.e., hook 166) of its corresponding third weight plate 162, and the other third catch member 204 is aligned with the latch feature 165 (i.e., hook 166) of its corresponding third weight plate 162. Referring to FIGS. 16A and 16B, when the user's force is applied on the exercise portion to perform the exercise, the second main resister 144 plus the whole add-a-weight resister 148 (i.e., both third weight plates 162) is lifted (e.g., two thirty-pound weight plates+the Tare weight+two five-pound weight plates=eighty-five pounds).

An example of a selector configuration for the available resistance settings is described in the following with reference to FIGS. 17 and 18. It should be understood that virtually unlimited variations of the weight resistance settings can be provided by suitable arrangement of the resisters.

FIG. 17 illustrates an example arrangement of the resisters of the resistance exercise apparatus 100. In this example, the first main resister 140 includes a single fifteen-pound weight plate, the second main resister 144 includes a pair of thirty-pound weight plates, and the third add-a-weight resister 148 includes a pair of five-pound weight plates. In the illustrated construction, another main resister includes a pair of fifteen-pound weight plates symmetrically arranged outside the second main resister 144, and a further main resister includes a pair of sixty-pound weight plates, each symmetrically arranged outside the other main resister. It should be understood that the weight stack could be configured in another arrangement according to various requirements. It should also be understood that selection of only a portion of the add-a-weight resister (e.g., one third weight plate 162) may cause only a slight unbalance of the resistance. However, considering the relatively small resistance of the add-a-weight plates 162, as well as its proximity to the axis 126, this slight unbalance should not significantly affect exercise, nor cause any significant binding on the guide rods 124.

FIG. 18 is a table showing available resistance settings corresponding to the selector configuration of the weight stack of FIG. 17. It can be seen that the resistance has forty-eight available settings ranging from fifteen pounds (Tare) to two hundred fifty pounds (Tare+all weight plates) in five-pound intervals.

In another example, the weight sizes may be derived by multiplying a basic weight increment by a binary factor as follows:

Example: basic weight increment=5 pounds

Weight sizes are:

$5\times2^0=5$ (optional central weight)

$(5\times2^1)/2=5$ (two weights on either side of the central weight)

$(5\times2^2)/2=10$ (two weights on either side of the central weight)

$(5\times2^3)/2=20$ (two weights on either side of the central weight)

$(5\times2^n)/2=\ldots$

Division by 2 is used to provide two symmetrical weights for a balanced arrangement.

In the example, the user can add any combination of five, ten, twenty, forty pounds, etc. to achieve a plurality of total resistance settings.

Example: Add forty+twenty+five pound weights to get sixty-five pounds of total resistance.

Figure 19:
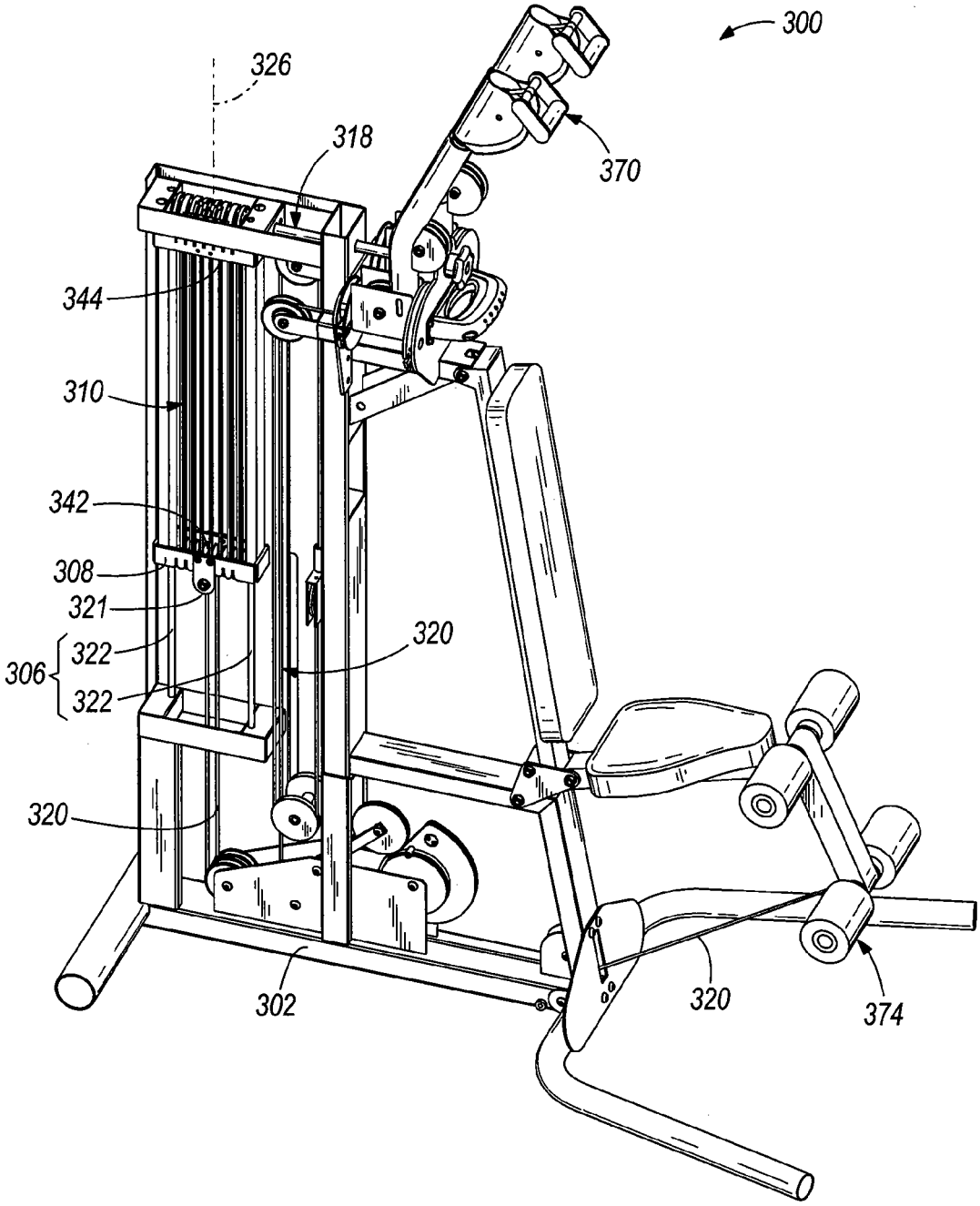
FIG. 19 is a perspective view of another resistance exercise apparatus embodying independent aspects of the present invention.

FIG. 19 illustrates a resistance exercise apparatus 300 in accordance with another independent embodiment. The resistance exercise apparatus 300 generally includes an apparatus frame 302, a guide 306 mounted on the apparatus frame 302, a resistance carriage or resistance support 308 movable along the guide 306, a resistance assembly 310 for applying a resistance during an exercise, an adjustment assembly 318 for adjusting the resistance to be applied during exercise, and a transmission assembly 320 coupled to the resistance support 308 at an input location 321.

In the illustrated construction, the guide 306 includes two parallel guide rods 322. The resistance support 308 is slidable on the guide rods 322 along an axis 326. The transmission assembly 320 is connected to at least one exercise assembly connected to the resistance support 308. In the example illustrated in FIG. 19, the transmission assembly 320 is connected to a first exercise assembly 370, for arm-driven exercise, and a second exercise assembly 374, for leg-driven exercise. The exercise assemblies 370 and 374 may be any conventional exercise assembly.

The resistance assembly 310 includes structure to apply resistance during exercise, e.g., a plurality of resisters each having a resistance. In the illustrated construction, the resistance exercise apparatus 300 is an elastomeric resistance apparatus, and the resisters include elastomeric members, such as, for example, bungee cords. The resistance of the resisters can be selectively and independently applied by the resisters during an exercise. Also, the illustrated resisters are arranged substantially symmetrically relative to the axis 326 and horizontally spaced.

Figure 20:
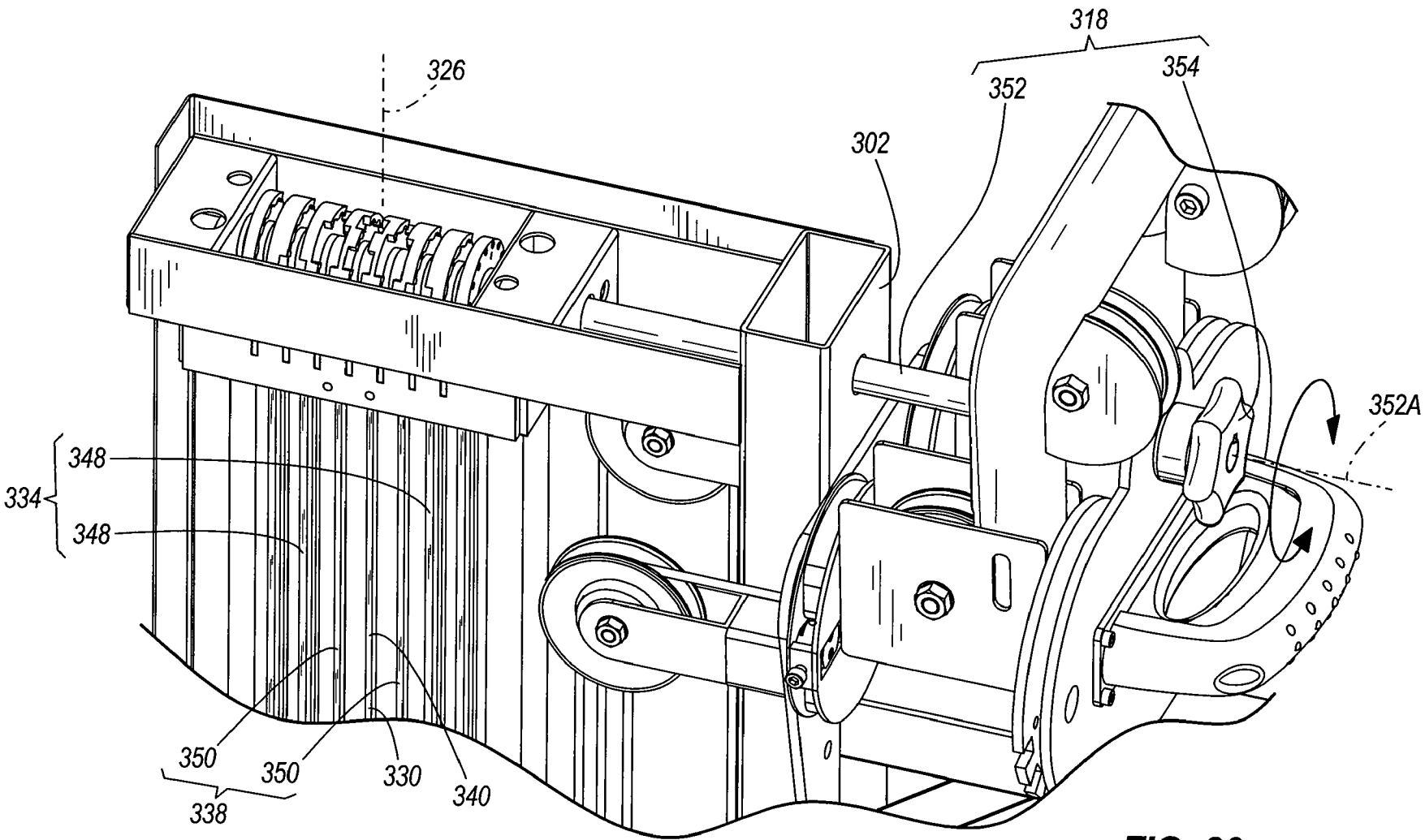
FIG. 20 is an enlarged perspective view of a portion of the resistance exercise apparatus of FIG. 19.
Figure 21:
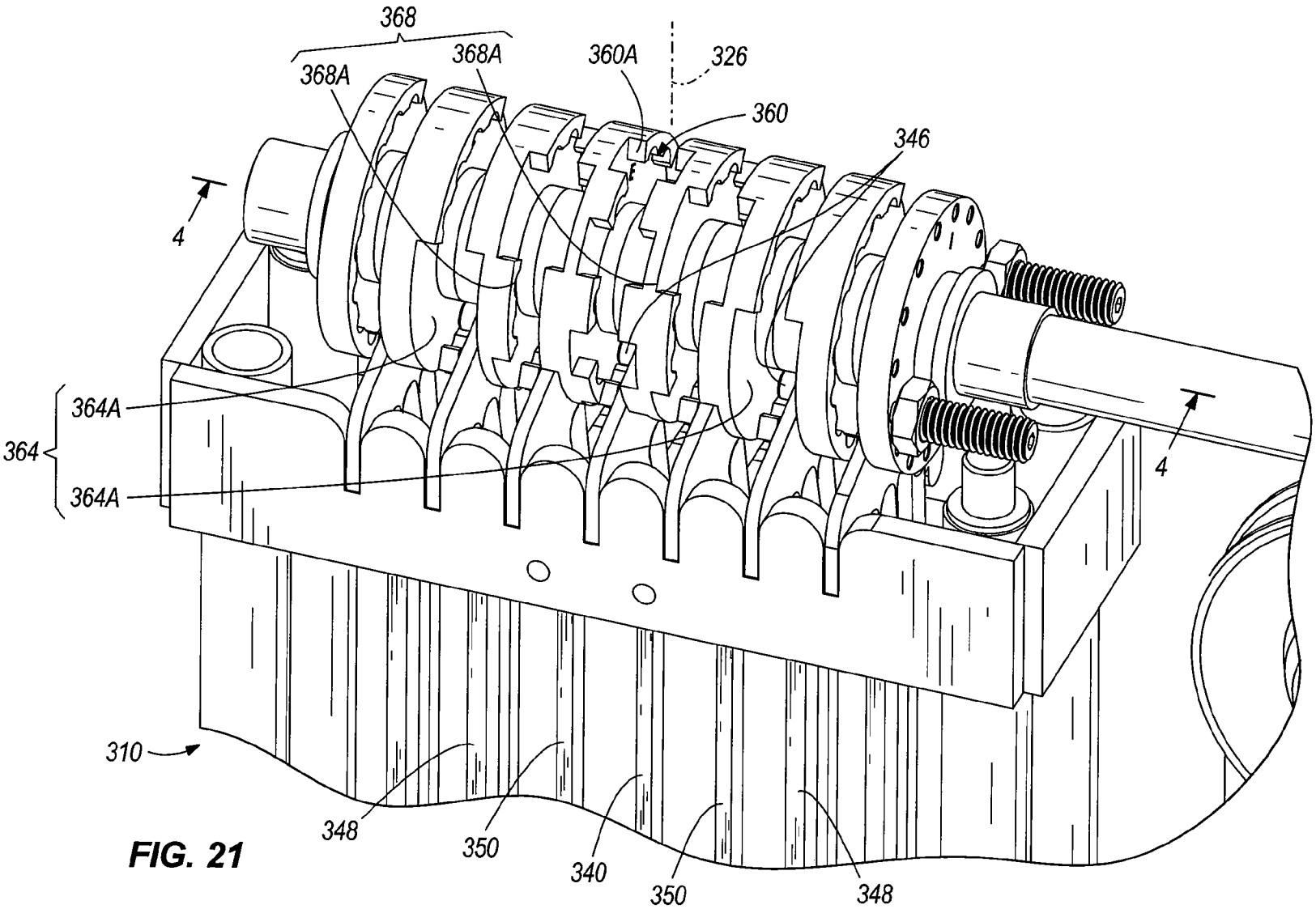
FIG. 21 is the view of FIG. 20 with some parts removed for clarity.

As shown in FIGS. 20 and 21, the resistance assembly 310 of this construction includes four resisters, each including at least one resistance member (e.g., a bungee cord). Only three of the four resisters will be described in detail as representatives to show features of the resistance assembly 310, and the three resisters are hereinafter referred to as a first resister 330, a second resister 334, and a third resister 338. It should be understood that "first", "second", and "third" are used herein for purpose of description only and could refer to any resister of the resistance assembly 310.

The first resister 330 includes a single first bungee cord 340 disposed substantially symmetrically on the axis 326. The first bungee cord 340 has opposite first and second cord ends 342 and 344 (shown in FIG. 19). The first cord end 342 is attached to a bottom side of the resistance support 308 to which the transmission assembly 320 is attached. The second cord end 344 is selectively engaged with a top side of the resistance support 308. A latch feature is formed on the second cord end 344. In this example, the latch feature includes a bungee cord hook or catch 346 attached to the second cord end 344 (shown in FIG. 22).

The second resister 334 includes two second bungee cords 348. The two second bungee cords 348 are disposed on opposite sides of the first bungee cord 340 to be substantially symmetrical relative to the axis 326. The second bungee cords 348 of the second resister 334 may have similar structure as the first bungee cord 340, and thus each have a bungee cord latch feature.

The third resister 338 includes two bungee cord sets 350. The two bungee cord sets 350 to be substantially symmetrical relative to the axis 326. The bungee cord sets 350 of the third resister 338 have similar structure as the first bungee cord 340, and thus each set has a bungee cord latch feature.

In the example illustrated in FIG. 19, the resistance exercise apparatus 300 is shown in a generally vertical orientation. However, because gravity is not required for creating the resistance, the resistance exercise apparatus 300 could be placed in another orientation, e.g., horizontally along the apparatus frame 302, an inclined orientation, etc. Therefore, directional terms (e.g., "top", "bottom", "vertical", "horizontal", etc.) used herein are for description only and are not intended to be limiting.

While the first resister 330 includes a single first bungee cord 340, and the second and third resisters 334 and 338, and the other resister, each include two or more bungee cords (348 and 350, respectively), it should be understood that each of the resisters could have one, two or more bungee cords. The total resistance of any one resister can be set in many ways, including grouping identical bungee cords, using bungee cords with different inherent retraction forces (possibly different geometries or different materials), prestretching bungee cords to attain different retraction forces, etc. In addition, while bungee cords are described here, many other solutions could be used to generate resistance, such as springs, pneumatic gas shocks, hydraulic pistons, etc. It is also to be understood that the number of the resisters of the resistance assembly 310 could be different according to various requirements, and, thus, the resistance assembly 310 could include more or fewer than four resisters.

The adjustment assembly 318 includes a selecting shaft 352 and a selector 354 attached to an end of the selecting shaft 352. The selecting shaft 352 extends along and is rotatable about a shaft axis 352A. A plurality of rotating engagement discs, selector discs or catches are supported on the selecting shaft 352, in positions corresponding to the resisters of the resistance assembly 310, and are rotatable with the selecting shaft 352. A first catch 360, a second catch 364 and a third catch 368 correspond to the first resister 330, the second resister 334 and the third resister 338, respectively. A single first bungee cord catch member 360A corresponds to the first bungee cord 340 of the first resister 330. Second bungee cord catch members 364A correspond to the second bungee cords 348 of the second resister 334. Third bungee cord catch members 368A correspond to the third bungee cords 350 of the third resister 338. Each of the catch members is formed with one or more catch features in a manner similar to that described above.

The catches on the selecting shaft 352 selectively engage the bungee cords by indexing one catch feature/protrusion portion to a position beneath one latch feature on the bungee cords. Conversely, by indexing an opening portion to a position beneath the latch feature on the bungee cords, the catches do not engage the bungee cords. Accordingly, rotating the selecting shaft 352 to one of a plurality of index points causes the catches to engage or to not engage the bungee cords in a preset pattern, thus changing the total number of bungee cords and the total resistance selected.

In the illustrated example, the selector 354 is a selector knob drivingly attached to the selecting shaft 352. Resistance selection is controlled by rotating the selector 354.

In the illustrated construction, the resistance assembly 310 includes only "main" resisters. In other constructions (not shown), the resistance assembly 310 of the resistance exercise apparatus 300 may also be arranged to have main resisters and add-a-weight resister(s) as in the earlier-described embodiment, thereby increasing the resolution of the resistance exercise apparatus 300. In such constructions, separate selection arrangements may be provided to facilitate selection of the main resister and of the add-a-weight resister(s).

In the illustrated construction, when selected and engaged with a catch feature, the second end of the selected bungee cord remains stationary during exercise. The second end of each unselected bungee cord moves with the resistance support 308 during exercise. Accordingly, the catches and the selecting shaft 352 are vertically fixed on the apparatus frame 302.

In an alternative construction, the second end of the selected bungee cord could move during exercise, and the second end of each unselected bungee cord could remain stationary during exercise. In such a construction, the selecting shaft 352 could be arranged to be movable with the resistance support 308, as in the earlier-described embodiment. To accommodate such movement and/or to place the selector 354 at a remote position (e.g., a more ergonomical position), an adjustment mechanism, similar to that in the earlier-described embodiment, may further be used to cooperate with the selector 354 to select a resistance.

Figure 22:
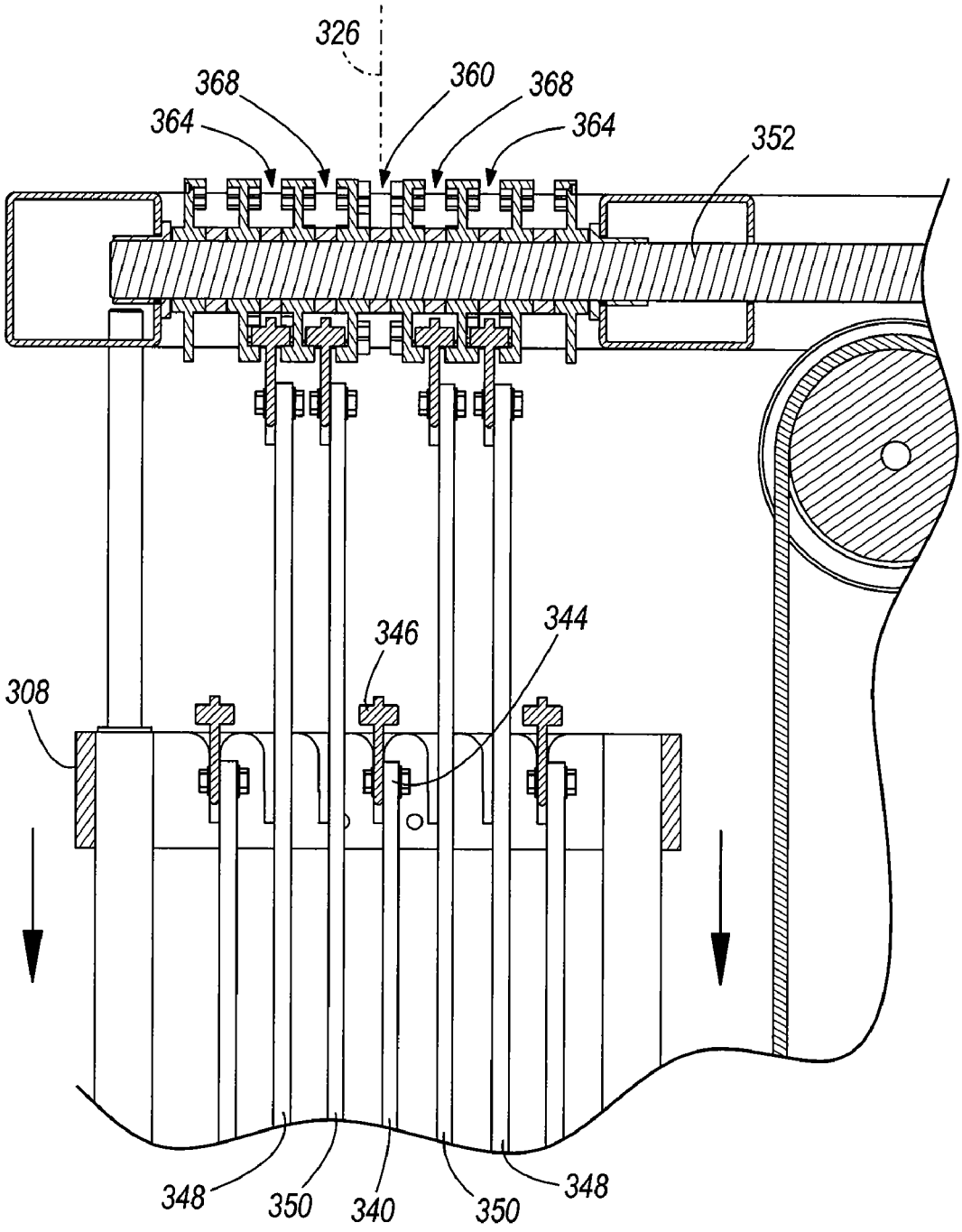
FIG. 22 is a section view taken along line 22-22 in FIG. 21.
Figure 23:
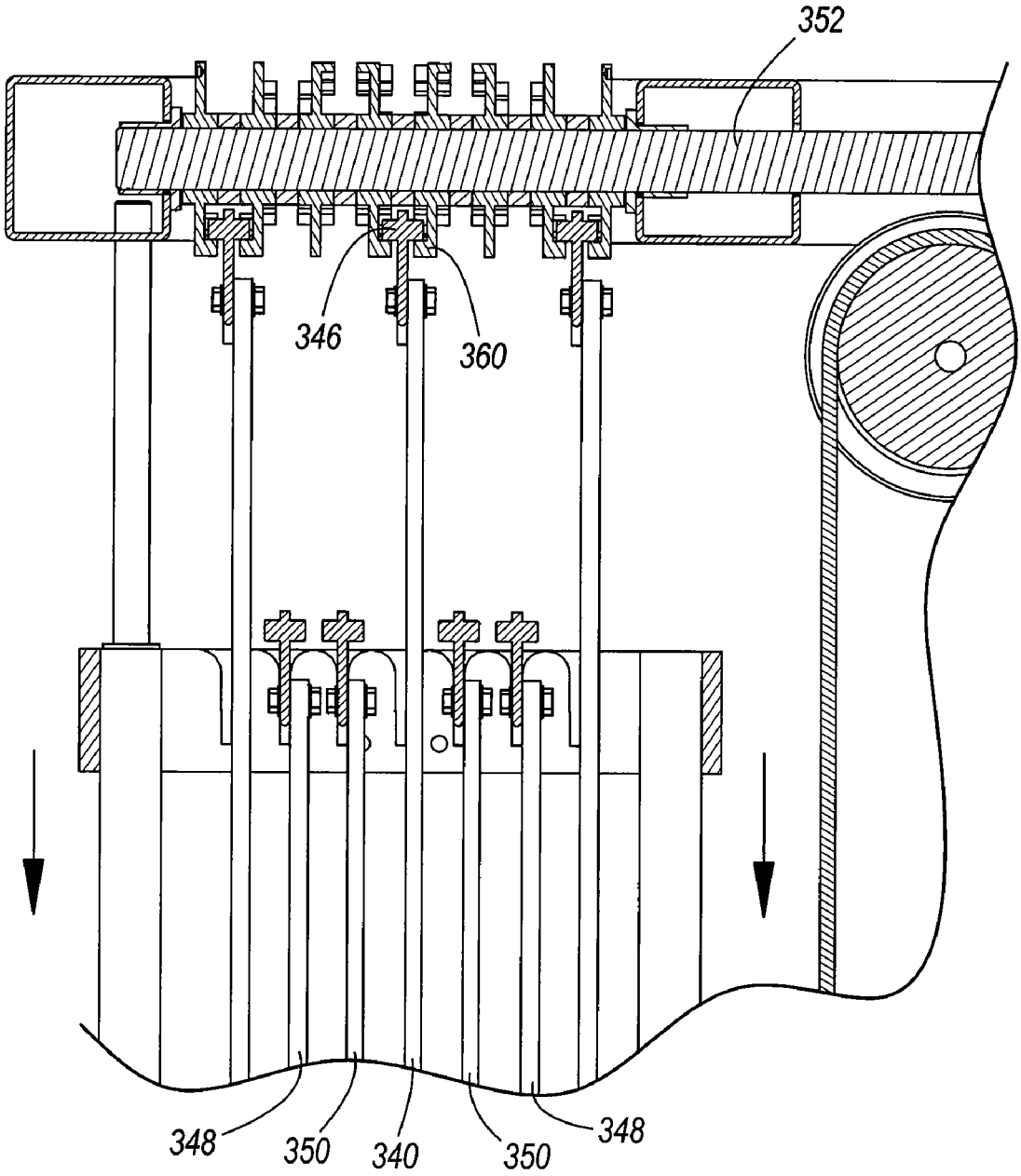
FIG. 23 is a view similar to FIG. 22 illustrating a different resistance setting during exercise.

FIGS. 22 and 23 illustrate engagement of the catch features with the latch features of resisters in different preset positions. Referring to FIG. 22, the second catch 364 and the third catch 368 on the selecting shaft 352 engage the bungee cord catches of the second resister 334 and the third resister 338, and, thus, the bungee cords of the second resister 334 and the third resister 338 are selected and stretched during an exercise. Referring to FIG. 23, the first catch 360 and another outermost catch on the selecting shaft 352 engage the bungee cord catches of the first resister 330 and an outermost resister, and, thus, the bungee cords of the first resister 330 and the outermost resister are selected and stretched during exercise.

Figure 24:
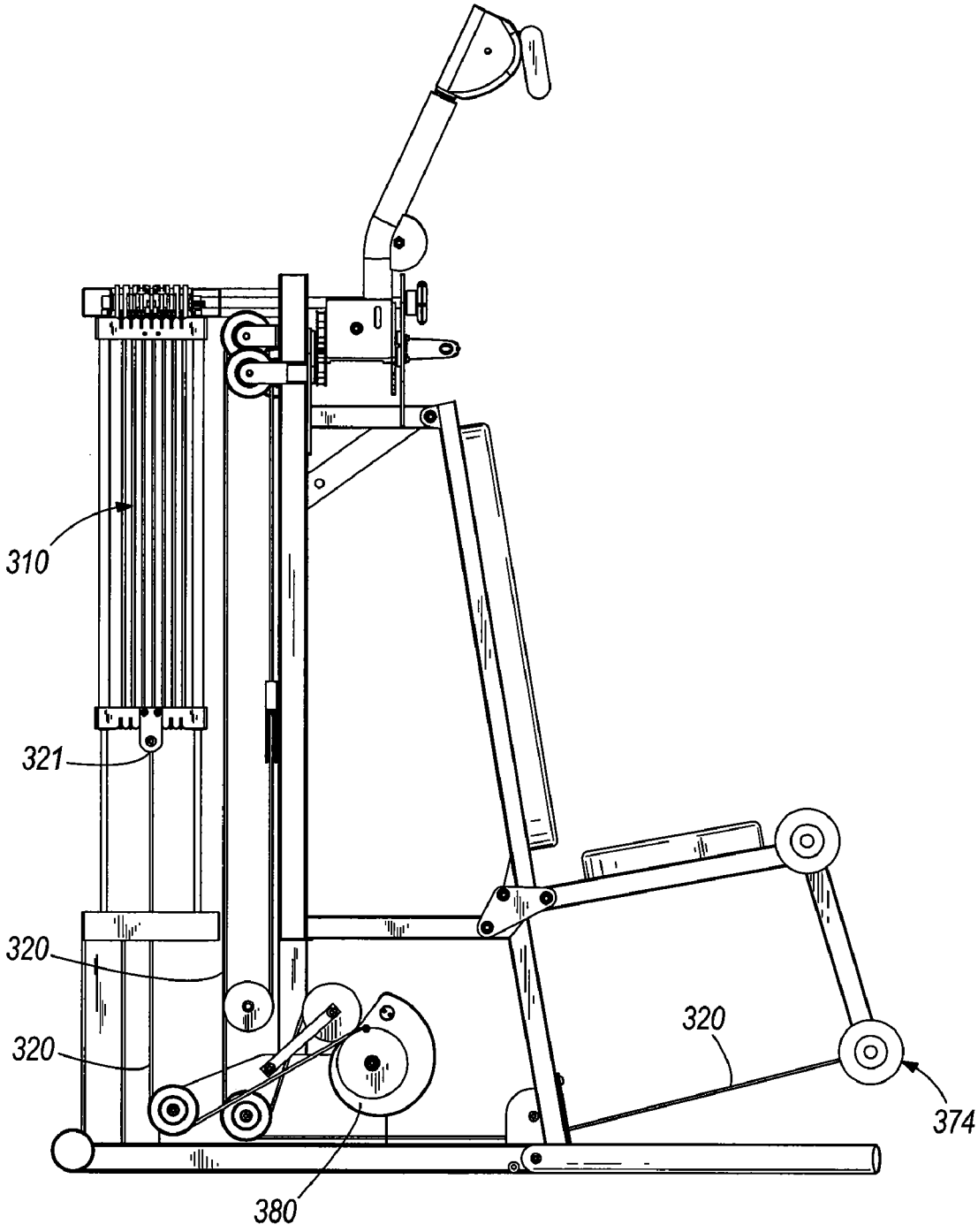
FIG. 24 is a side view illustrating a resting condition of the resistance exercise apparatus of FIG. 19.
Figure 25:
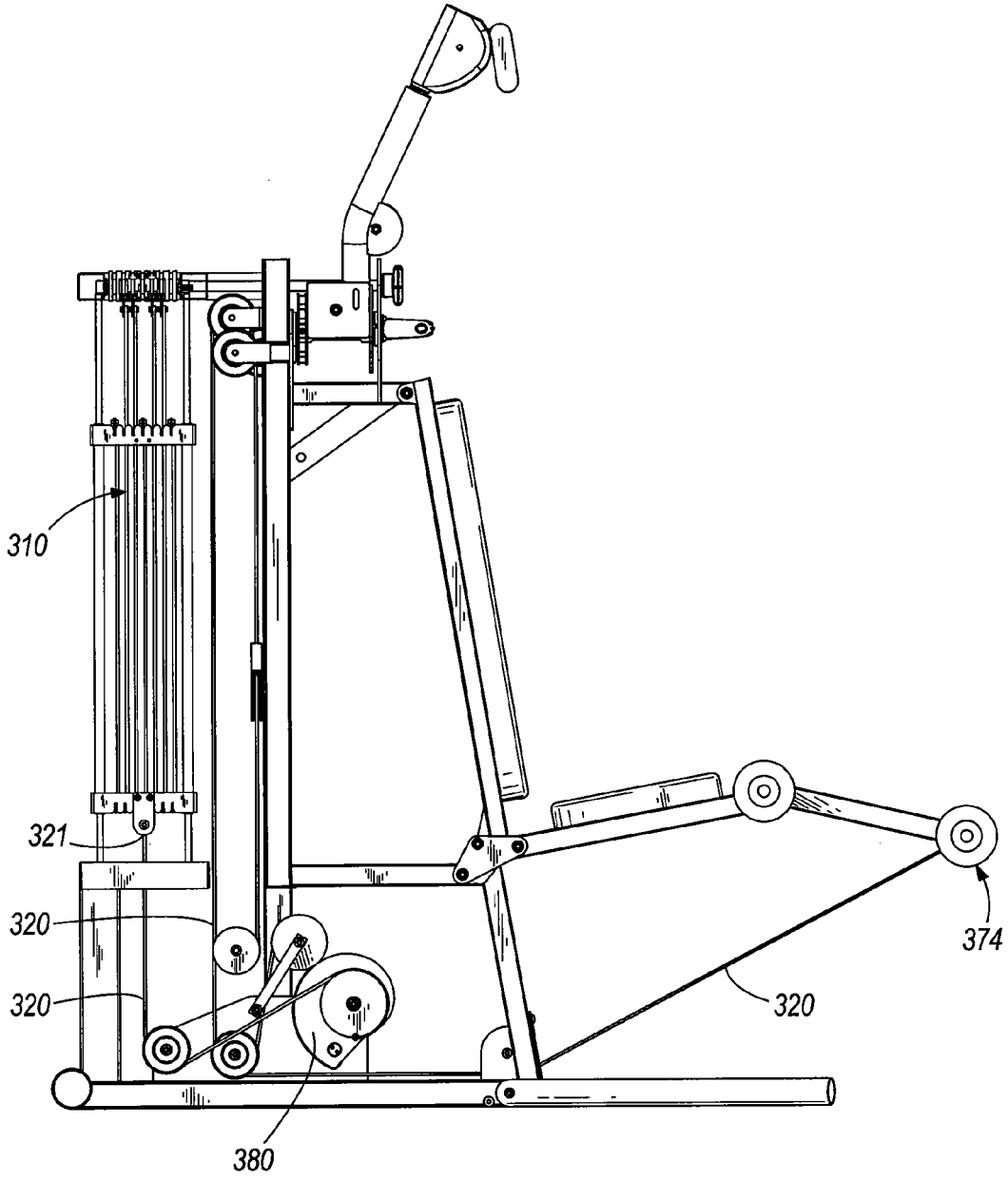
FIG. 25 is a side view illustrating an exercising condition of the resistance exercise apparatus of FIG. 19.

Most springs, bungee cords, and elastomeric resistance devices have a non-constant force curve (typically, these structures produce a substantially ramped force curve, approximated by the equation, $F=a*x+b$, in which "a" and "b" are typically positive constant values). Users of resistance strength equipment are more accustomed to a flat, constant force curve, as is produced using a traditional weight stack for the resistance. Referring to FIGS. 24 and 25, optionally, a cam-profile pulley 380 can be used in conjunction with the elastomeric resistance assembly 310 to convert load applied by the resistance assembly 310 to a substantially constant force curve load, as felt by the user.

FIGS. 26-30 illustrate a different weight adjustment mechanism 400 that can be used with an exercise apparatus like that illustrated in FIGS. 1 and 2. Unlike the apparatus illustrated in FIGS. 1 and 2, the adjustment mechanism 400 of FIGS. 26-30 utilizes a single user input for selecting the desired weight to be used during the exercise. The details of this single user input are described below in more detail.

The adjustment mechanism 400 of FIGS. 26-30 includes an input gear 402 that is adapted to be manipulated by the user. For example, the input gear 402 can be driven directly by a user input knob (not shown) or a selector similar to the selector 174 illustrated in FIG. 2.

Figure 28:
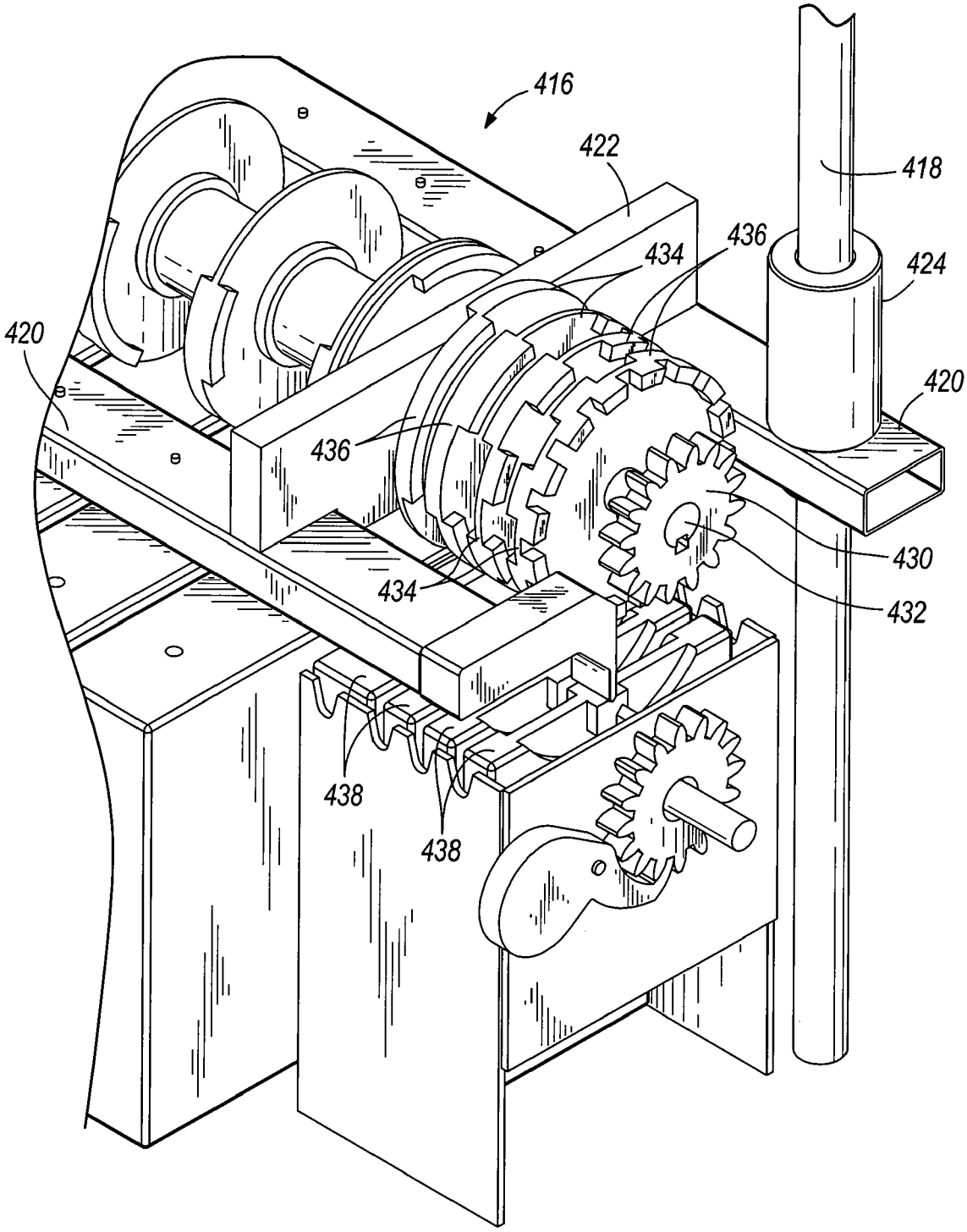
FIG. 28 is a view showing the resistance carriage being lifted during an exercise.
Figure 29:
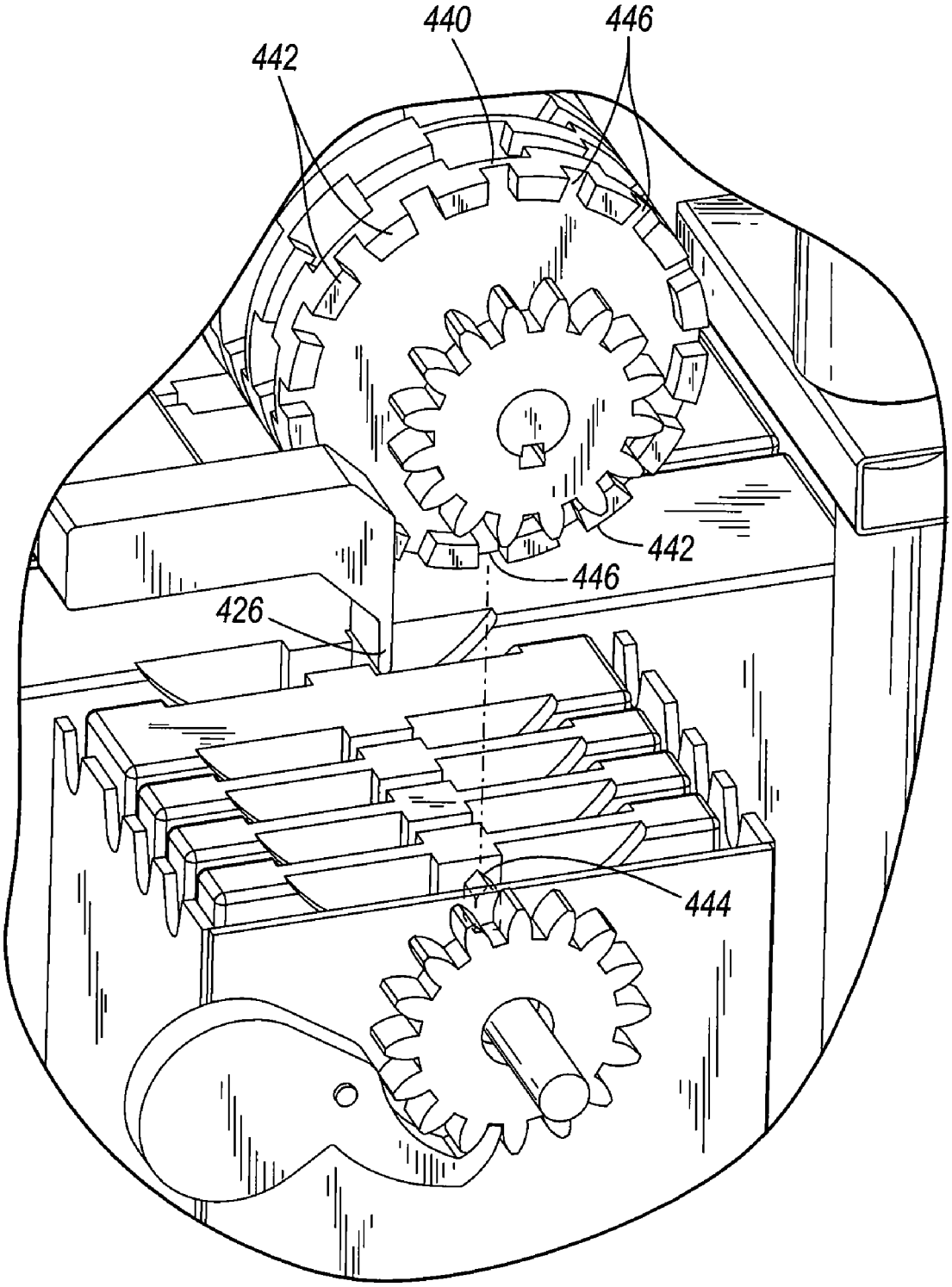
FIG. 29 is a perspective view of the interlock assembly in a locked position.

An interlock assembly 404 operates to ensure that the input gear 402, and thus the rest of the adjustment mechanism 400, is only allowed to move when the mechanism 400 is in the resting position (when the weights are not lifted by a user). The interlock assembly 404 includes an interlock pawl 406 that is pivotally mounted to a side plate 408 and is adapted to move between an unlocked position (FIGS. 26-27) and a locked position (FIGS. 28-29). In the locked position, the interlock pawl 406 substantially prevents rotation of the input gear 402. In the unlocked position, the interlock pawl 406 allows rotation of the input gear 402.

The interlock pawl 406 is biased toward the locked position. In the illustrated embodiment, the bias is provided by the weight of a weighted portion 410 on the interlock pawl 406. Due to the positioning of the weighted portion relative to a pivot 412, the interlock pawl 406 is biased in a counterclockwise direction (as viewed in FIGS. 26-29) to bias a latch portion 414 into engagement with the input gear 402.

A carriage 416 is designed to move vertically on two rods 418. The carriage 416 includes two side rails 420, two bearing blocks 422, and two bushings 424 adapted to slide on the rods 418. The carriage 416 can move from a resting position (FIGS. 26-27) to a raised position (e.g., FIGS. 28-30) when lifted at an input location 421.

Figure 26:
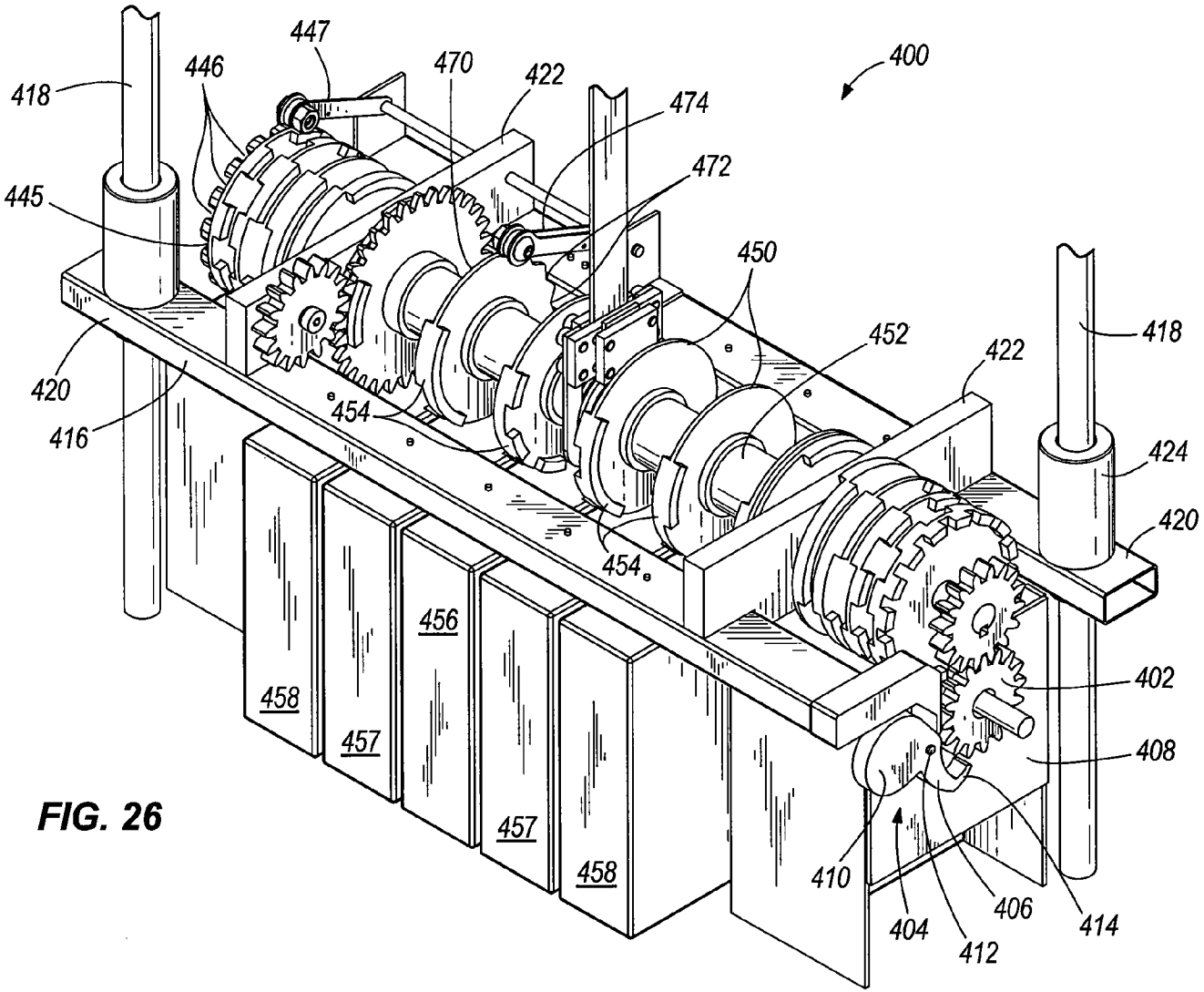
FIG. 26 is a perspective view of another resistance exercise apparatus embodying independent aspects of the present invention.
Figure 27:
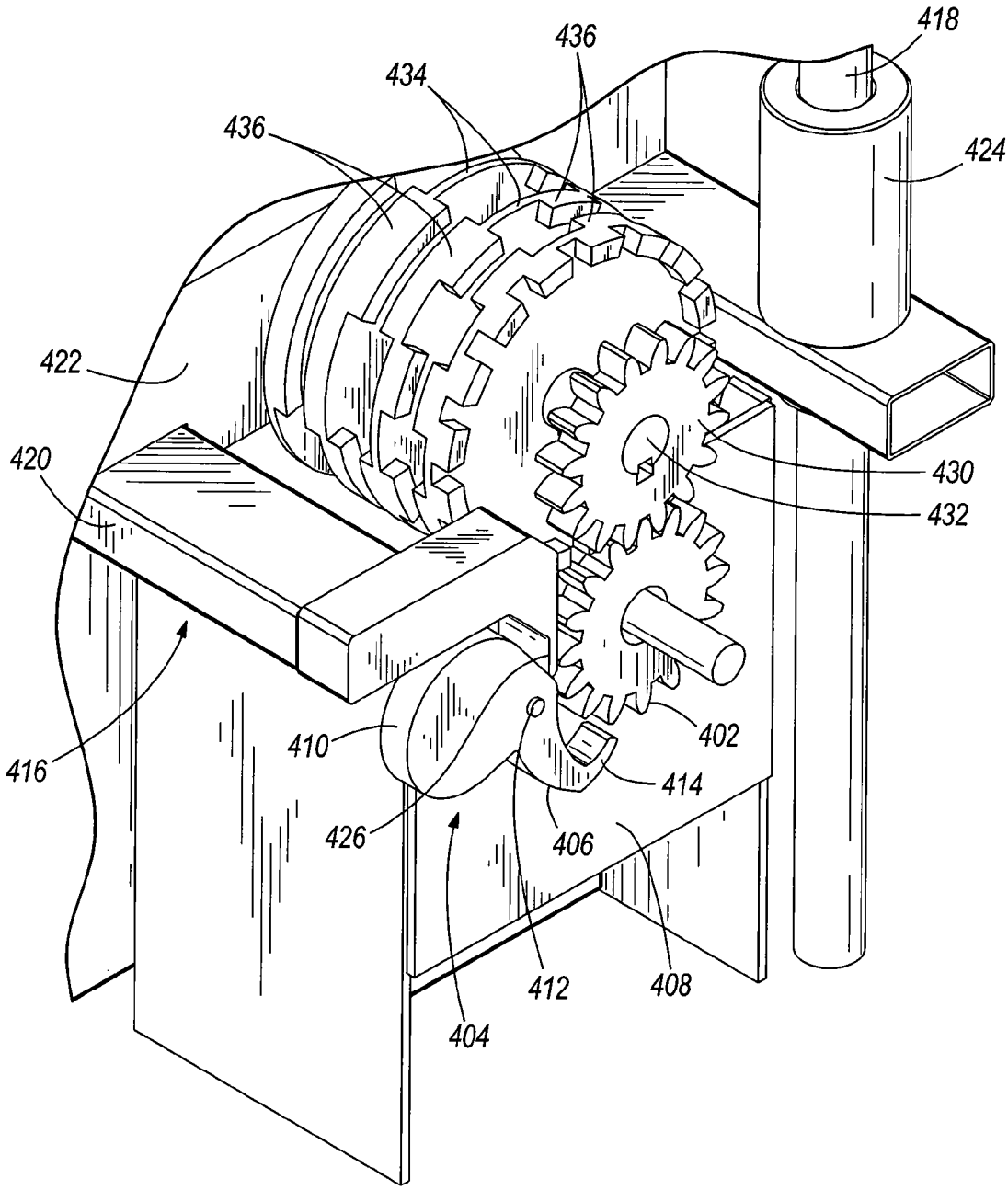
FIG. 27 is a perspective view of the interlock assembly in an unlocked position.

The carriage 416 further includes a release lever 426 that is adapted to move the interlock pawl 406 to the unlocked position when the carriage is in the resting position (FIGS. 26-27).

The adjustment mechanism 400 further includes an adjustment gear 430 mounted on and rotatable with an adjustment shaft 432. The adjustment shaft 432 is mounted for rotation on the two bearing blocks 422 that form part of the carriage 416. Accordingly, the adjustment shaft 432 and adjustment gear 430 move with the carriage 416, resulting in the adjustment gear 432 engaging the input gear 402 when the carriage 416 is in the resting position, and disengaging the input gear 402 when the carriage 416 is in a raised position.

A plurality of primary selector discs 434 are secured to and rotate with the adjustment shaft 432. Each pair of adjacent selector discs 434 forms catch features 436 that are adapted to selectively engage a corresponding weight plate 438 positioned below the primary selector discs 434. The details of the primary selector discs 434, catch features 436, and weight plates 438 are substantially similar to those same features described above in connection with the embodiment of FIGS. 1-16.

Referring to FIG. 29, a first selector disc 440 includes a series of index tabs 442 extending axially from the periphery of the disc. An index boss 444 is mounted to the side plate 408 and extends toward the first selector disc 440. The index tabs 442 are separated by index spaces 446 that are designed to be aligned with the index boss 444 when the mechanism is properly rotationally positioned on one of sixteen rotational settings. That is, when the adjustment mechanism 400 is properly rotationally positioned on a setting, an index space 446 will be aligned with the index boss 444, which allows the carriage 416 to be raised to perform an exercise. However, if the adjustment mechanism 400 is not properly positioned on a setting (e.g., it is between two settings), one of the index tabs 442 will be aligned with the index boss 444. In this position, when the user tries to raise the carriage 416, the index tab 442 will contact the index boss 444, preventing upward movement of the carriage 416. In this manner, the adjustment mechanism 400 ensures that the rotational orientation of the adjustment shaft 432 is on a desired setting and not between two adjacent settings.

Figure 30:
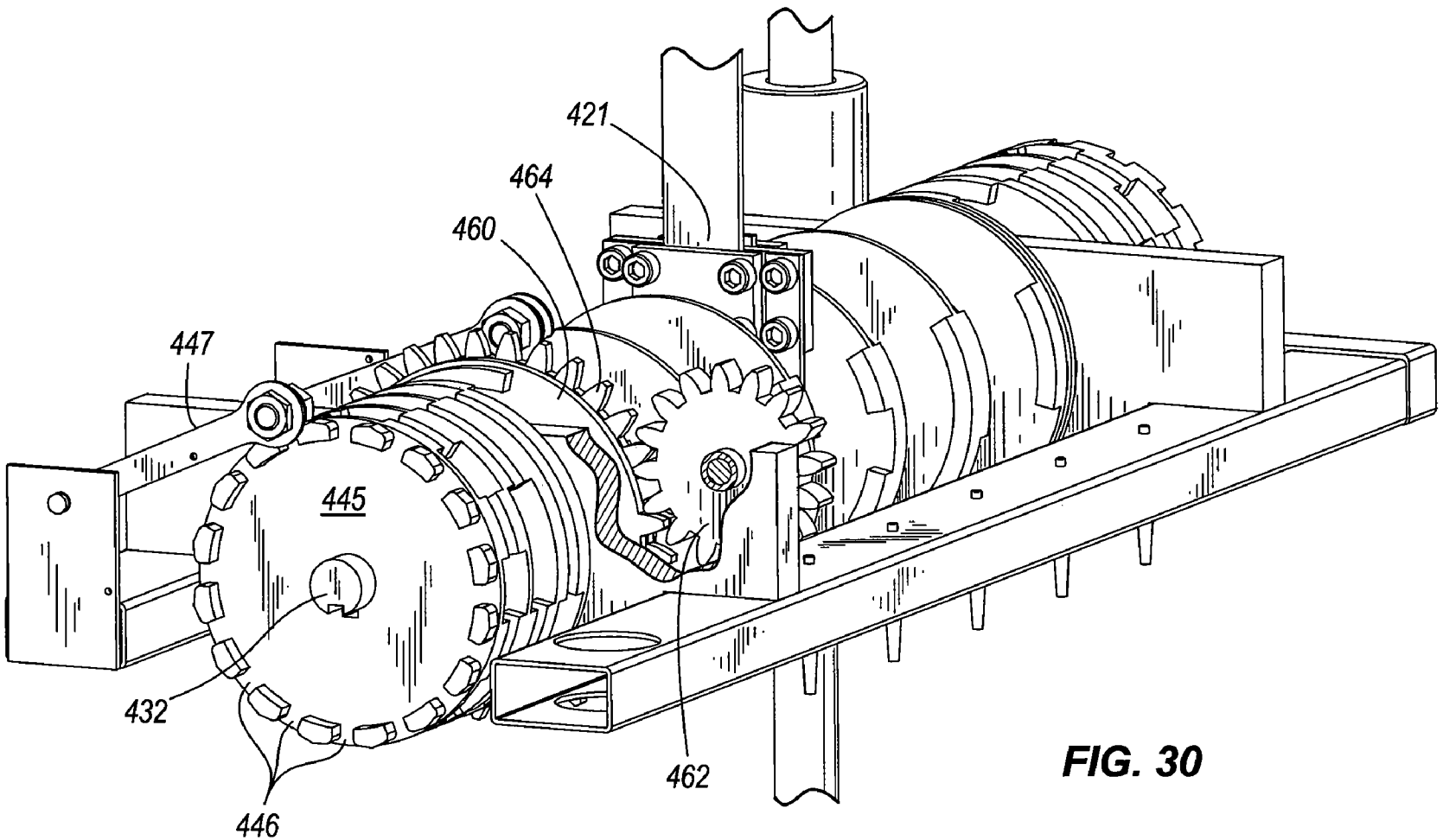
FIG. 30 is a perspective view of the detent feature and the multi-revolution indexing feature.

Referring to FIGS. 26 and 30, a last selector disc 445 is provided with a series of circumferentially-spaced recesses 446 that cooperate with a detent mechanism 447. The detent mechanism is biased into contact with the recesses 446, and both features are positioned such that they act to bias the primary shaft 432 in each of the sixteen rotational positions.

Referring to FIG. 26, the adjustment mechanism 400 further includes several secondary selector discs 450 positioned between the bearing blocks 422. These secondary selector discs 450 are mounted to and rotate with a secondary shaft 452 that is hollow and rotates around the adjustment shaft 432. The secondary shaft 452 is rotatably supported on its ends by the bearing blocks 422. Similar to the primary selector discs 434, the secondary selector discs 450 include catch features 454 that are designed to selectively engage weight plates 456, 457, 458 positioned below the secondary selector discs 450. The details of the secondary selector discs 450, catch features 454, and weight plates 456 are substantially similar to those features on the apparatus illustrated in FIGS. 1-16.

The secondary shaft 452 includes six indexed rotational positions. In the first position, none of the catch features 454 are aligned with the weights 456, 457, 458, and thus none of the weights 456, 457, 458 are engaged. In the second indexed position, the secondary shaft 452 is rotated such that certain catch features 454 are aligned with the first weight plate 456. In the third indexed position, the secondary shaft 452 is rotated such that catch features 454 are aligned with the two second weight plates 457. In the fourth indexed position, the secondary shaft 452 is rotated such that catch features 454 are aligned with the first weight plate 456 and the two second weight plates 457. In the fifth indexed position, the secondary shaft 452 is rotated such that catch features 454 are aligned with the two second weight plates 457 and the two third weight plates 458. In the sixth indexed position, the secondary shaft 452 is rotated such that catch features 454 are aligned with all of the weight plates 456, 457, 458.

Figure 31:
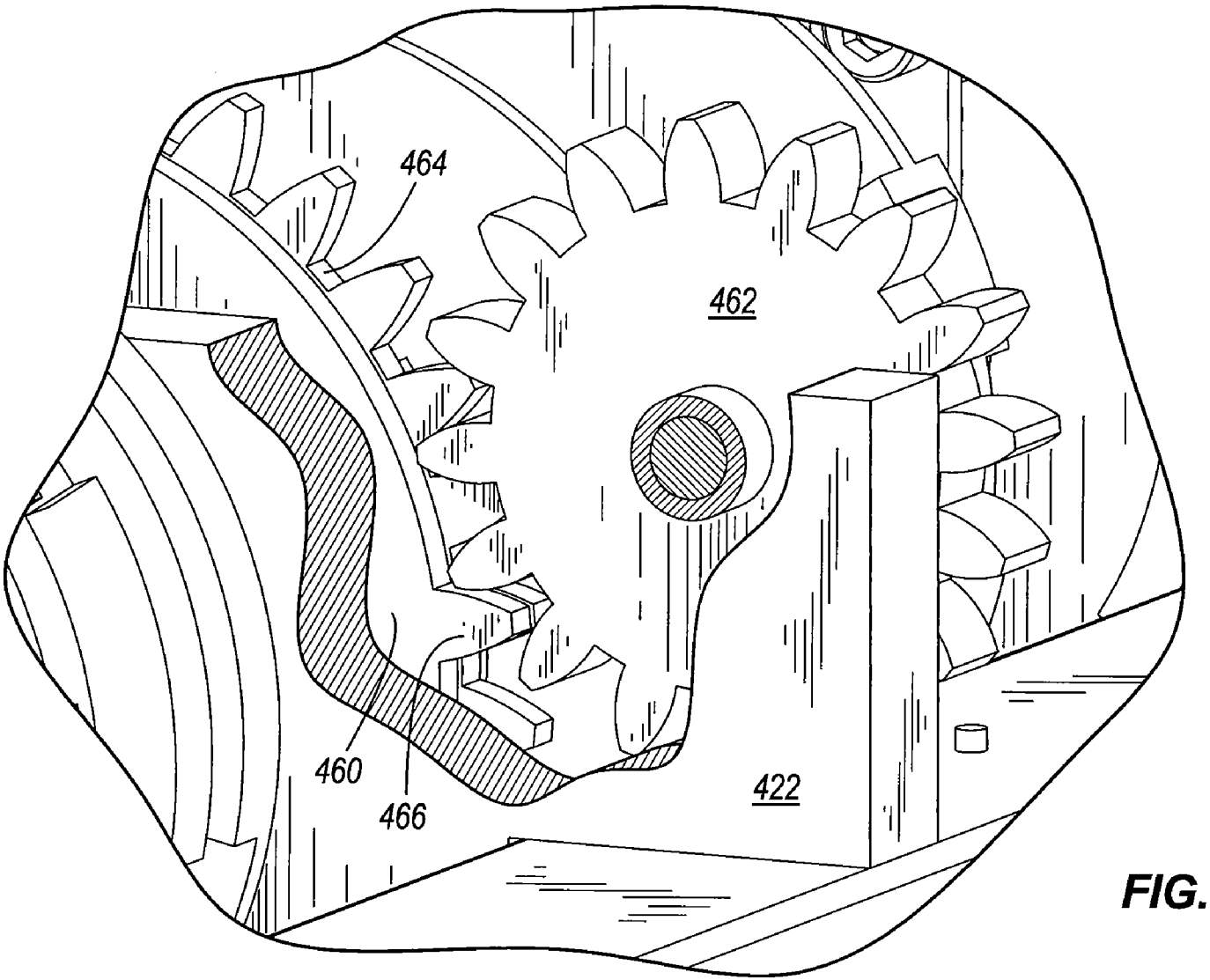
FIG. 31 is an enlarged perspective view of a portion of the multi-revolution indexing feature of FIG. 30.

The secondary shaft 452 is designed such that it moves one indexed position for every full rotation of the primary adjustment shaft 432. The indexing of the secondary shaft 452 relative to the primary shaft 432 is accomplished by a rotary indexing mechanism that converts rotary motion of the primary shaft 432 to intermittent rotary motion of the secondary shaft 452. Referring to FIGS. 30-31, the rotary indexing mechanism includes a drive wheel 460 attached to and rotatable with the primary shaft 432, a follower gear 462 mounted for rotation on one of the bearing blocks 422, and an indexing gear 464 coupled to and rotatable with the secondary shaft 452. The drive wheel 460 includes a drive tooth 466 that intermittently engages the follower gear 462 once per revolution of the drive wheel 460 and primary shaft 432. Each full revolution of the drive wheel 460 results in rotational displacement of three teeth (three-sixteenths of a rotation) on the follower gear 462.

The follower gear 462 is intermeshed with the indexing gear 464 such that rotation of the follower gear 462 results in rotation of the indexing gear 464. The indexing gear 464 includes 32 teeth. A three-tooth rotation of the follower gear 462 (three-sixteenths rotation) results in a three-tooth rotation of the indexing gear 464 (three-thirty-secondths rotation). The three-thirty-secondths rotation of the indexing gear 464 and secondary shaft 452 corresponds with the spacing between the six index positions of the secondary shaft 452. Accordingly, it can be seen that each revolution of the primary shaft 432 will result in movement of the secondary shaft 452 from one indexed position to the next. This indexing of the secondary shaft 452 can occur in either direction, depending on the rotational direction of the primary shaft 432.

Referring back to FIG. 26, one of the secondary selector discs 470 is provided with a series of circumferentially-spaced recesses 472 that cooperate with a detent mechanism 474. The detent mechanism is biased into contact with the recesses 472, and both features are positioned such that they act to bias the secondary shaft 452 in each of the six indexed positions.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

One or more independent features and/or independent advantages may be set forth in the following claims:

We claim:

1. A resistance exercise apparatus comprising:

a frame;

a guide mounted on the frame;

a resistance support movable on said guide and including an input location;

a transmission assembly coupled to the input location; a user engagement exercise member connected to said transmission assembly; and a resistance assembly for applying a resistance to the resistance support during an exercise, the resistance assembly including:

a first resister having a first resistance, and a second resister having a second resistance, the first resistance and the second resistance being capable of being independently applied by the first resister and the second resister, the first resister and the second resister each being arranged substantially symmetrical relative to the input location, wherein the first resister and the second resister each include at least two elastomeric members arranged substantially symmetrical relative to the input location.

2. The apparatus of claim 1, wherein the guide includes two guide rods, and wherein the resistance support is slidable along the guide rods.

3. The apparatus of claim 1, wherein the elastomeric members include a bungee member.

4. The apparatus of claim 1, wherein the resistance support is movable substantially vertically, and wherein the first resister and the second resister are horizontally spaced from each other.

5. The apparatus of claim 1, wherein the resistance assembly further includes a third resister having a third resistance, the third resistance being selectively and independently applied by the third resister during an exercise, the third resister being arranged substantially symmetrical relative to the input location.

6. The apparatus of claim 1, further comprising an adjustment assembly engageable with the resistance assembly to adjust the resistance to be applied by the resistance assembly during an exercise, the adjustment assembly including:

a selector supported on the frame; and an adjustment mechanism interconnected with the selector and engageable with the resistance assembly to adjust the resistance to be applied by the resistance assembly during an exercise.

7. A resistance exercise apparatus comprising:

a frame;

a resistance support supported on and movable relative to the frame; a user engagement exercise member connected to said transmission assembly;

a resistance assembly at least partially movable with the resistance support during exercise; and an adjustment assembly including a selector supported on the frame, and an adjustment mechanism interconnected with the selector and engageable with the resistance assembly to adjust the resistance to be applied by the resistance assembly, the resistance support being disengageable from and movable relative to the selector during the exercise, wherein the adjustment mechanism includes a resistance gear assembly supported by the resistance assembly for movement with the resistance assembly during exercise, and an adjustment gear assembly supported by the frame and interconnected with the selector, wherein the adjustment gear assembly is engageable with the resistance gear assembly, wherein the resistance near assembly and the adjustment gear assembly are operable to adjust the resistance to be applied by the resistance assembly, and wherein the resistance gear assembly is disengageable from the adjustment gear assembly during exercise.

8. The apparatus of claim 7, further comprising an interlock assembly including a resistance gear lock assembly operable to retain the resistance gear assembly in a resistance setting orientation when the resistance gear assembly and the adjustment gear assembly are disengaged, the lock assembly including a pin engageable in a locking position between gear teeth of the resistance gear assembly to substantially prevent rotation of the resistance gear assembly from a resistance setting orientation when the resistance gear assembly and the adjustment gear assembly are disengaged, the pin being disengageable to an unlocking position when the resistance gear assembly and the adjustment gear assembly are engaged.

9. The apparatus of claim 8, wherein the interlock assembly further includes an adjustment gear lock assembly operable to retain the adjustment gear assembly in a resistance setting orientation when the resistance gear assembly and the adjustment gear assembly are disengaged, the adjustment gear lock assembly including:

an adjustment gear pin engageable in a locking position between gear teeth of the adjustment gear assembly to substantially prevent rotation of the adjustment gear assembly from a resistance setting orientation when the resistance gear assembly and the adjustment gear assembly are disengaged, the pin being disengageable to an unlocking position when the resistance gear assembly and the adjustment gear assembly are engaged, and a biasing member operable to bias the adjustment gear pin toward the locking position.

10. The apparatus of claim 9, wherein the resistance gear lock assembly further includes a pin support plate supporting the pin, the pin support plate engaging a surface as the resistance gear assembly engages with the adjustment gear assembly to move the pin from the locking position, the pin being movable from the unlocking position toward the locking position by gravity, wherein the adjustment gear lock assembly includes a pin support on which the adjustment gear pin is supported, and wherein the pin support plate is engageable with the pin support as the resistance gear assembly engages with the adjustment gear assembly to move the adjustment gear pin from the locking position.

11. The apparatus of claim 7, wherein the adjustment mechanism further includes:

a selecting shaft extending along and rotatable about a shaft axis, a first catch supported on the selecting shaft and engageable with a first resister in at least a first rotated position of the selecting shaft such that a first resistance is to be applied by the resistance assembly, and a second catch supported on the selecting shaft and engageable with a second resister in at least a second rotated position of the selecting shaft such that a second resistance is to be applied by the resistance assembly, wherein the resistance gear assembly includes a resistance gear drivingly connected to the selecting shaft, the resistance gear being engageable with the adjustment gear assembly and being operable to rotate the selecting shaft about the shaft axis in response to operation of the selector to a resistance selecting position.

12. The apparatus of claim 11, wherein the first catch and the second catch are arranged on the selecting shaft such that, in a first rotated position of the selecting shaft, the first catch engages the first resister and the second catch is disengaged from the second resister such that the first resistance is to be applied by the resistance assembly, such that, in a second rotated position of the selecting shaft, the first catch is disengaged from the first resister and the second catch engages the second resister such that the second resistance is to be applied by the resistance assembly, and such that, in a third rotated position of the selecting shaft, the first catch engages the first resister and the second catch engages the second resister such that the first resistance and the second resistance are to be applied by the resistance assembly.

13. The apparatus of claim 11, wherein the resistance assembly further includes a third resister having a third resistance, the third resistance being selectively and independently applied by the third resister during an exercise, and wherein the adjustment mechanism further includes a second selecting shaft extending along and rotatable about a second shaft axis, and a third resister catch supported on the second selecting shaft and engageable with the third resister in at least a first rotated position of the second selecting shaft such that at least a portion of the third resistance is to be applied by the resistance assembly, wherein the resistance gear assembly includes a second resistance gear drivingly connected to the second selecting shaft, the second resistance gear being engageable with the adjustment gear assembly and being operable to rotate the second selecting shaft about the second shaft axis in response to operation of the selector to a resistance selecting position.

14. The apparatus of claim 13, wherein the third resister includes one third resistance member providing a first portion of the third resistance and another third resistance member providing a second portion of the third resistance, wherein the third resister catch includes one third resistance member catch member and another third resistance member catch member respectively engageable with the one third resistance member and the other third resistance member, and wherein, in a first rotated position of the second selecting shaft, the one third resistance member catch engages the one third resistance member such that the first portion of the third resistance is to be applied, and, in a second rotated position of the second selecting shaft, the other third resistance member catch engages the other third resistance member such that the second portion of the third resistance is to be applied.

15. The apparatus of claim 13, wherein the first-mentioned shaft has an inner bore defined along the first-mentioned shaft axis, and wherein the second selecting shaft is rotatably received in the bore of the first-mentioned selecting shaft.

16. The apparatus of claim 13, wherein the second selecting shaft includes a screw shaft portion, and wherein the third resister catch threadingly engages the screw shaft portion such that the third resister catch moves axially along the second shaft axis between a third resister engaging position and a disengaged position upon rotation of the second selecting shaft.

17. The apparatus of claim 13, wherein the adjustment gear assembly includes a first adjustment gear engageable with the first-mentioned resistance gear, and a second adjustment gear engageable with the second resistance gear, the first adjustment gear and the second adjustment gear being independently operable by the selector such that the first-mentioned selecting shaft and the second selecting shaft are independently rotatable by the adjustment gear assembly.

18. The apparatus of claim 17, wherein the selector includes a first selector interconnected with the first adjustment gear and operable to adjust the resistance to be applied by the first resister, and a second selector interconnected with the second adjustment gear and operable to adjust the resistance to be applied by the second resister.

19. A resistance exercise apparatus comprising:

a frame;

a resistance support supported on and movable relative to the frame;

a resistance assembly having first and second registers at least partially movable with the resistance support by a user engagement member; and an adjustment assembly including a selector supported on the frame, and an adjustment mechanism interconnected with the selector and engageable with the resistance assembly to adjust the resistance to be applied by the resistance assembly, the resistance support being disengageable from and movable relative to the selector during the exercise, wherein the resistance support is movable along an axis, and wherein the first resistance and the second resistance are selectively and independently applied by the first resister and the second resister during an exercise, the first resister and the second resister each being horizontally spaced from each other and arranged substantially symmetrical relative to the axis.

* * * * *